US008439114B2

(12) United States Patent
Parrott et al.

(10) Patent No.: US 8,439,114 B2
(45) Date of Patent: May 14, 2013

(54) METHOD AND APPARATUS FOR ORIENTING PERFORATING DEVICES

(75) Inventors: Robert A. Parrott, Houston, TX (US); David Mills, Sugar Land, TX (US); Cynthia L. Hickson, Sugar Land, TX (US); Jerry D. Campbell, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 1198 days.

(21) Appl. No.: 11/425,876

(22) Filed: Jun. 22, 2006

(65) Prior Publication Data

US 2008/0264639 A1 Oct. 30, 2008

Related U.S. Application Data

(60) Division of application No. 10/435,320, filed on May 9, 2003, now Pat. No. 7,114,564, which is a continuation-in-part of application No. 10/133,755, filed on Apr. 27, 2002, now Pat. No. 7,000,699.

(60) Provisional application No. 60/286,907, filed on Apr. 27, 2001.

(51) Int. Cl.
*E21B 43/118* (2006.01)

(52) U.S. Cl.
USPC ..... 166/297; 166/55.2

(58) Field of Classification Search ..... 166/297, 166/55.2, 242.6, 255.2; 175/4.51, 4.53
See application file for complete search history.

(56) References Cited

U.S. PATENT DOCUMENTS

| | | | | | |
|---|---|---|---|---|---|
| 1,987,316 | A | * | 1/1935 | Zimmer | 464/78 |
| 2,500,359 | A | * | 3/1950 | Jewett | 277/362 |
| 3,014,542 | A | * | 12/1961 | Hildebrandt et al. | 175/107 |
| 3,089,416 | A | | 5/1963 | Gilbert | |
| 3,145,787 | A | * | 8/1964 | Brown | 175/107 |
| 4,153,118 | A | | 5/1979 | Hart | |
| 4,410,051 | A | * | 10/1983 | Daniel et al. | 175/4.51 |
| 4,438,810 | A | | 3/1984 | Wilkinson | |
| 4,523,649 | A | | 6/1985 | Stout | |
| 4,613,002 | A | * | 9/1986 | Pittman et al. | 175/107 |
| 4,637,478 | A | * | 1/1987 | George | 175/4.51 |
| 5,010,964 | A | | 4/1991 | Cornette | |
| 5,040,619 | A | * | 8/1991 | Jordan et al. | 175/4.51 |
| 5,163,721 | A | | 11/1992 | Babuder | |
| 5,176,406 | A | | 1/1993 | Straghan | |
| 5,211,714 | A | * | 5/1993 | Jordan et al. | 166/297 |
| 5,259,466 | A | | 11/1993 | Venditto et al. | |
| 5,273,121 | A | | 12/1993 | Kitney et al. | |

(Continued)

FOREIGN PATENT DOCUMENTS

| | | | |
|---|---|---|---|
| EP | 0452126 | B1 | 10/1991 |
| GB | 2128719 | A | 5/1984 |

(Continued)

*Primary Examiner* — Daniel P Stephenson
(74) *Attorney, Agent, or Firm* — Robert A. Van Someren

(57) ABSTRACT

The present invention provides an apparatus and method of orienting perforating gun strings conveyed on a tool string. One embodiment of the present invention provides an orienting weight provided in a portion of the perforating device, such as the shaped charge, the loading tube or the gun housing. An adapter is provided intermediate the tool string that facilitates conveyance of the gun string downhole. Additionally, the adapter enables the gun string to rotate independent of the tool string.

12 Claims, 21 Drawing Sheets

U.S. PATENT DOCUMENTS

| | | | | |
|---|---|---|---|---|
| 5,285,683 | A | 2/1994 | Abass et al. | |
| 5,318,123 | A | 6/1994 | Venditto et al. | |
| 5,335,724 | A | 8/1994 | Venditto et al. | |
| 5,366,014 | A | 11/1994 | George | |
| 5,394,941 | A | 3/1995 | Venditto et al. | |
| 5,603,379 | A | 2/1997 | Henke et al. | |
| 5,778,979 | A | 7/1998 | Burleson et al. | |
| 5,964,294 | A | 10/1999 | Edwards et al. | |
| 6,003,599 | A | 12/1999 | Huber et al. | |
| 6,173,773 | B1 | 1/2001 | Almaguer et al. | |
| 6,230,825 | B1 * | 5/2001 | Aumann et al. | 175/246 |
| 6,378,607 | B1 | 4/2002 | Ryan et al. | |
| 6,591,911 | B1 | 7/2003 | Markel et al. | |
| 6,595,290 | B2 | 7/2003 | George et al. | |
| 6,679,327 | B2 | 1/2004 | Sloan et al. | |
| 7,000,699 | B2 * | 2/2006 | Yang et al. | 166/255.2 |
| 7,114,564 | B2 | 10/2006 | Parrott et al. | |
| 2005/0092493 | A1 | 5/2005 | Sukup et al. | |
| 2007/0175637 | A1 * | 8/2007 | Leising et al. | 166/297 |

FOREIGN PATENT DOCUMENTS

| | | | |
|---|---|---|---|
| GB | 2329659 | A | 3/1999 |
| GB | 2363449 | A | 12/2001 |
| GB | 2374887 | A | 10/2002 |
| RU | 2059806 | C1 | 5/1996 |
| RU | 2112877 | C1 | 6/1998 |
| RU | 2179235 | C1 | 2/2002 |
| WO | 0075485 | A1 | 12/2000 |

* cited by examiner

METHOD AND APPARATUS FOR ORIENTING PERFORATING DEVICES

This application is a divisional of and claims priority based on U.S. application Ser. No. 10/435,320, filed on May 9, 2003, which is a continuation-in-part of U.S. application Ser. No. 10/133,755, filed Apr. 27, 2002, which claims the benefit of U.S. Provisional Application No. 60/286,907, filed Apr. 27, 2001, U.S. Provisional Application No. 60/306,938, filed Jul. 20, 2001, U.S. Provisional Application No. 60/307,086, filed Jul. 20, 2001, U.S. Provisional Application No. 60/307,087, filed Jul. 20, 2001, U.S. Provisional Application No. 60/310,970, filed Aug. 8, 2001, U.S. Provisional Application No. 60/314,200, filed Aug. 22, 2001, and U.S. Provisional Application No. 60/351,252 filed Jan. 23, 2002.

BACKGROUND OF THE INVENTION

1. Field of Invention

The present invention relates to the field of perforating. More specifically, the invention relates to devices and methods to facilitate conveyance and orientation of perforating devices.

2. Background of the Invention

Formations penetrated by a downhole well, particularly horizontal or highly deviated wells, are studied to determine the most advantageous orientation of perforations. The desired orientation may be selected based on the possibility of sand production, based on the heavy overburden pressure and/or shear stress existing, or based on the location of control lines and/or other downhole equipment and tools.

There exists, therefore, a need for an apparatus and method for orienting perforating guns and for confirming that the correct orientation has been achieved.

SUMMARY

The present invention provides an apparatus and method for facilitating conveyance and orientation of perforating guns in a wellbore. In one embodiment, a swivel utilizes a bearing isolation device to help achieve a desired orientation of perforations. The swivel may be combined with a roller adapter to facilitate movement of a perforating system along the wellbore. A confirmation device also may be used to confirm the orientation of the perforations formed.

It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

Figure 1:
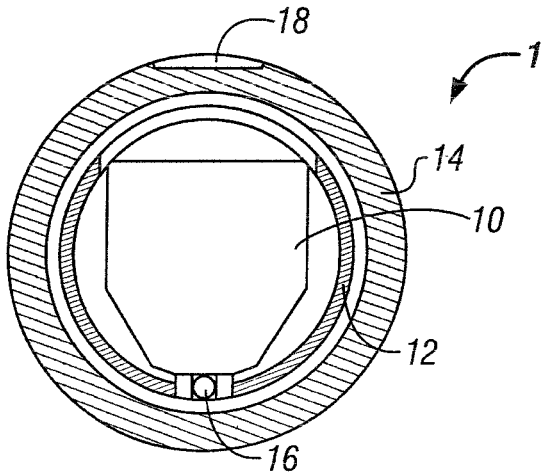
FIG. 1 (Prior Art)
FIG. 1 is a cross-sectional view of a prior art conventional perforating gun.

FIG. 1 shows a conventional perforating gun. The conventional perforating gun, indicated generally as 1, comprises a shaped charge 10, a loading tube 12, a gun carrier 14, and a detonating cord 16. The illustrated gun 1 also includes a scallop 18 machined out of the gun carrier 14 and aligned with the shaped charge 10. Although the illustrated conventional perforating gun 1 is a scalloped gun 1, it is important to note that the present invention is equally applicable to slick-walled guns.

Figure 2:
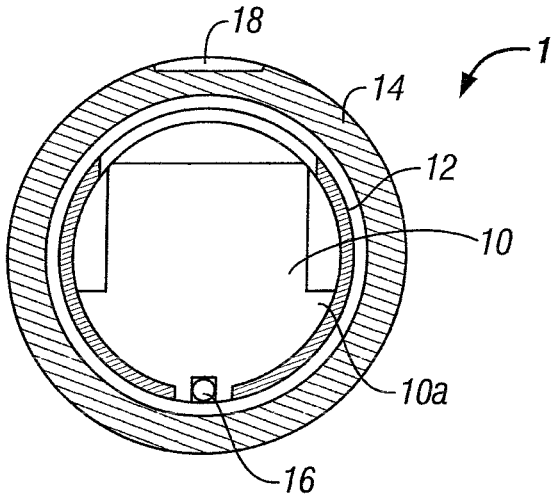
FIG. 2 is a cross-sectional view of one embodiment of the present invention having a modified shaped charge geometry.

FIG. 2 illustrates one embodiment of the present invention, wherein the geometry of the case of the shaped charge 10 is modified so that the weight distribution provides enough torque to orient the gun 1. As shown in FIG. 2, the case of the shaped charge 10 has additional material 10*a* provided thereon at the back, or bottom of the case of the charge 10, to provide an eccentric weight moving the center of gravity from the axis of the gun. Such a design causes the charge 10 to orient for firing in an upward direction. Note that the additional material/weight 10*a* may be integral with the shaped charge 10 or added thereto as a separate component such as by screwing a weight to the shaped charge 10.

Figure 3:
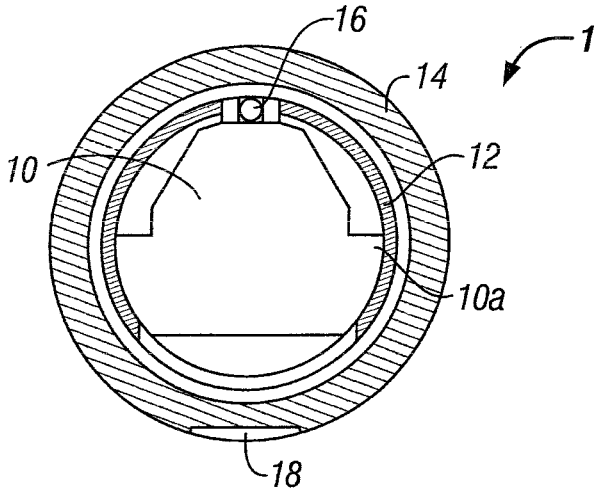
FIG. 3 is a cross sectional view of another embodiment of the present invention having a modified shaped charge geometry.

FIG. 3 illustrates another embodiment of the present invention, wherein the geometry of the case of the shaped charge 10 is modified. In the example of FIG. 3, additional material 1, a is provided at the front, or mouth, of the case of the charge 10. Such a design causes the charge 10 to orient in a downward direction. As discussed with reference to FIG. 2, the additional material/weight 10*a* may be integral with the shaped charge 10 or added thereto as a separate component.

Note that in alternate embodiments, the charge case 10 may be additionally mounted in such a way that the center of gravity is further removed from the axis of rotation Providing a plurality of charges 10 modified in the manner described with reference to FIG. 2 or 3 multiplies the effect of the eccentricity that can provide a significant orienting torque. For example, by modifying the geometry of the back of the PJ2906 charge case manufactured by SCHLUMBERGER TECHNOLOGY CORPORATION, 48 grams of extra material can be added per charge. For a 200 ft gun, an extra torque of 68 inch-lb is generated. This illustrative amount of torque represents a 40% increase over a 7 ft weighted spacer in a similar gun if steel is used as the weight material. Additionally, the gun using the modified shaped charge 10 of the present invention provides a better utilization of the space and provides a space savings.

Figure 4:
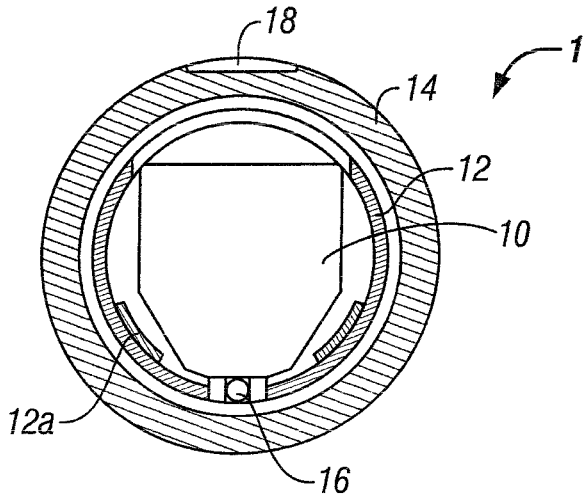
FIG. 4 is a cross-sectional view of another embodiment of the present invention having a modified loading tube.

FIG. 4 illustrates another embodiment of the present invention wherein the loading tube 12 is modified to provide the needed torque. For example, the loading tube 12 may have more material on one side of the tube 12 than the other. As shown in FIG. 4, the loading tube 12 has more material 12*a* on the bottom side (i.e., the side that is intended to be on bottom during firing). Accordingly, the loading tube 12 has an eccentric weight balance that has a center of gravity that is offset from the axis of rotation. In this way, gravity will cause the loading tube 12 to rotate and orient in a preferential manner.

Figure 5:
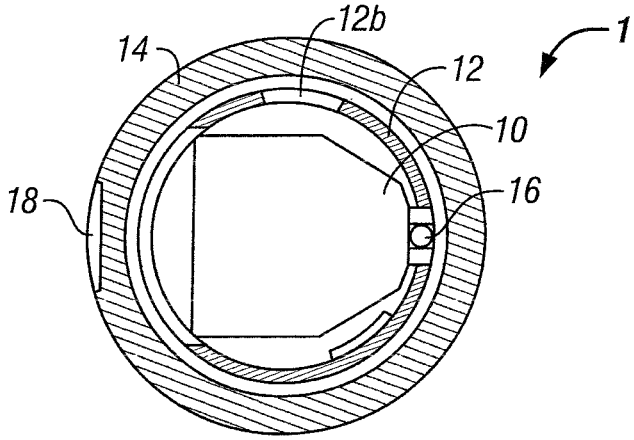
FIG. 5 is a cross-sectional view of another embodiment of the present invention having a modified loading tube.

The embodiment of FIG. 5 provides a loading tube 12 with material 12*b* removed from one side of the shaped charge 10 to provide for a different orientation than that provided in the embodiment of FIG. 4. In the embodiment of FIG. 5, the loading tube 12 has a center of gravity offset from the axis of rotation that tends to orient the shaped charges 10 in a horizontal direction.

Figure 6:
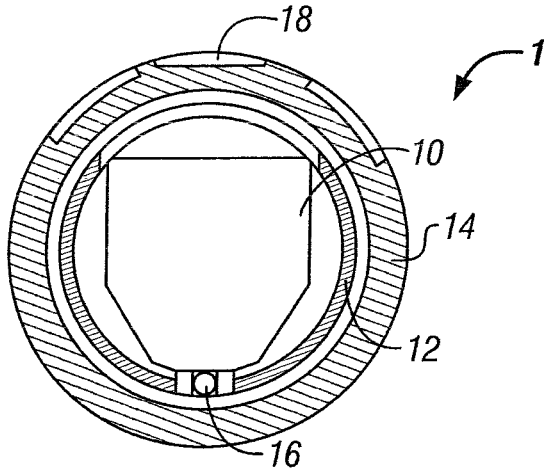
FIG. 6 is a cross-sectional view of another embodiment of the present invention having a modified gun carrier.

FIG. 6 illustrates an embodiment of the present invention where the gun carrier 14 is modified similarly. For the gun carrier 14, scallops or thinned portions 18 may be provided on one side of the gun carrier 14 so that the carrier 14 itself will provide a degree of preferential orientation. In FIG. 6, the gun carrier 14 has multiple scallops 18 provided its top portion. Thus, the housing has a center of gravity that is offset from the axis of rotation and gravity will cause the gun carrier 14 to rotate and orient in a preferential manner.

Figure 7:
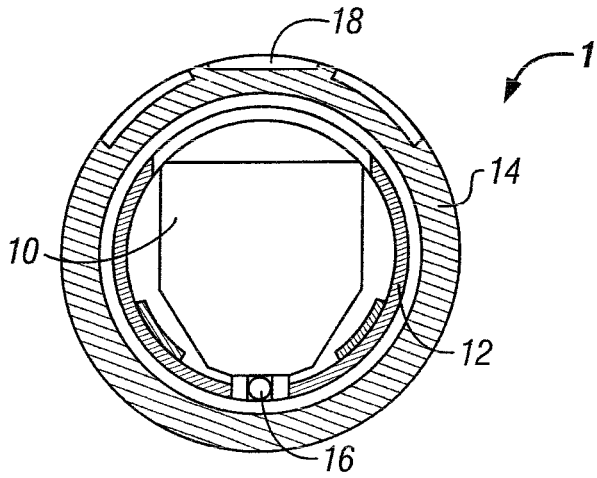
FIG. 7 is a cross-sectional view of another embodiment of the present invention having a modified gun carrier and loading tube.
Figure 8:
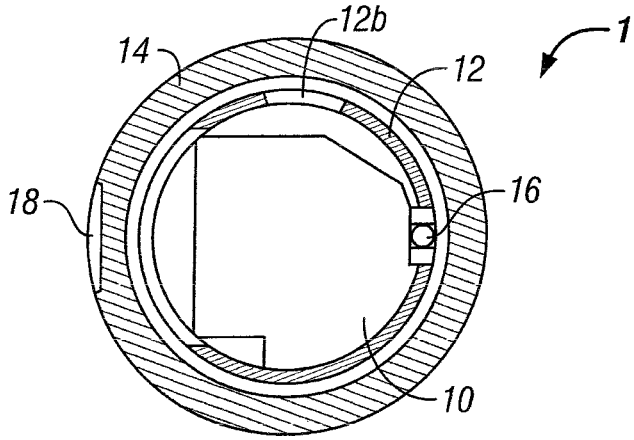
FIG. 8 is a cross-sectional view of another embodiment of the present invention having a modified shaped charge and loading tube.

The features described with reference to FIGS. 2 through 6 may be combined to enhance orientation or used individually. For example, as shown in FIG. 7, the gun 1 may use a modified gun carrier 14 and a modified loading tube 12 with conventional charges 10. Another example, shown in FIG. 8, combines modified charges 10 with a modified loading tube 12 and a conventional gun carrier 14. The above are intended to be illustrative and not limiting with respect to the possible combinations falling within the scope of the present invention.

The guns 1 of the present invention may include some charges 10 that are modified and some that are not modified, or conventional. As one example, of many possible, the charges 10 of a gun 1 oriented in a first direction are eccentric and of the modified type (i.e., having a center of gravity that is offset from the axis of rotation), whereas those oriented in another direction are of the conventional type. In another embodiment, the charges 10 are used in a gun 1 to provide an oriented 0-180° phasing arrangement.

Figure 9:
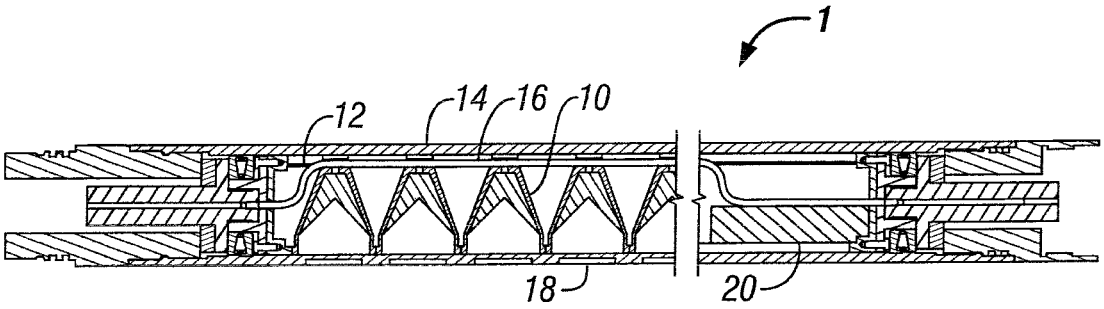
FIG. 9 illustrates an embodiment of the present invention having a weighted swiveling loading tube.

Another embodiment of the present invention, illustrated in FIG. 9, provides a perforating gun 1 having the shaped charges 10 mounted in a loading tube 12 that swivels within the gun carrier 14. In addition to the shaped charges 10, the loading tube 12 carries a weight 20 that causes the swiveling loading tube 12 to rotate to the orientation desired (downward in FIG. 9).

In the provided example, the weight 20 provided is a semicircular weight. However, other configurations remain within the scope of the invention. Further, the weight 20 can be any number of types or configurations such as hollow flask type weights filled with a high density material, or half solid metal bars, for example.

In the case of slick-walled perforating guns, no further alignment is necessary as the gun carrier 14 has a uniform thickness around its circumference. Similarly, in the case of a perforating gun 1 having machined grooves extending circumferentially around the gun carrier 14 at each shaped charge interval, no further gun 1 alignment is necessary.

Figure 10:
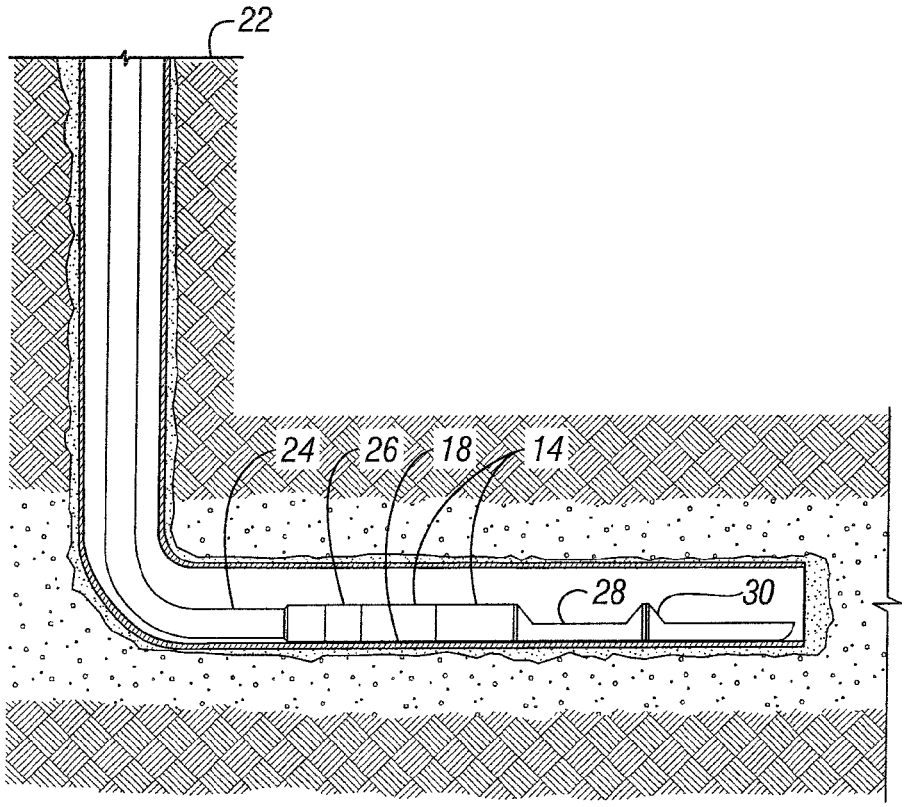
FIG. 10 illustrates an embodiment of the present invention having a swiveling loading tube and lower weights.

In the case of scalloped perforating guns 1, shown in FIG. 9, the gun carrier 14 must be oriented to align with the shaped charges 10 such that the shaped charges 10 shoot through the scallops 18. An embodiment of the present invention illustrated in FIG. 10, provides for orientation of the gun carrier 14. As shown, the gun carrier 14 is lowered into the well 22 by the work string 24. A swivel 26 is affixed between the gun carrier 14 and the work string 24 to enable the carrier 14 to rotate as necessary. One or more weights are affixed to the lower end of the carrier 14 to cause the carrier 14 to rotate such that the scallops 18 are facing downward.

The embodiment illustrated in FIG. 10 provides a middle weight 28 and a bottom weight 30. The middle weight 28 has a gun thread on the top end and a gun thread on the bottom for receipt of additional weights. The lower weight 30 has a rounded bottom end 30*a* to help guide the string 24 into liner tops and around the corner in highly deviated or horizontal wells. Because the middle weights 28 and bottom weights 30 are subject to well conditions, they can be made of heat treated steel to survive the trip in and out of the well.

It should be understood that the embodiment illustrated in FIG. 10 is provided as one example the numerous combinations of weights that can be used with the present invention. For example, a plurality of middle weights 28 can be used depending upon the orienting weight needed. Further, depending upon the application, if may not be necessary to provide any middle weights 28.

Figure 11:
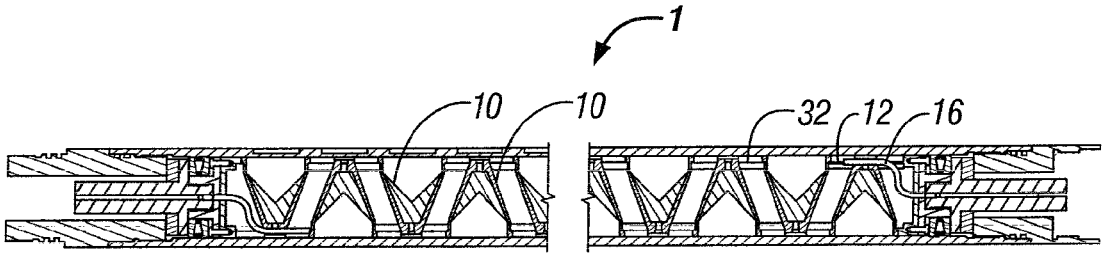
FIG. 11 illustrates an embodiment of the present invention wherein the loading tube is weighted around the shaped charges.

FIG. 11 illustrates another embodiment of the present invention wherein the loading tube 12 is weighted around the shaped charges 10. The perforating gun 1 is a slick-walled gun 1 having a swiveling loading tube 12 therein. However, this embodiment can also be used with a stationary loading tube 12 where the entire perforating gun 1 swivels. By surrounding a portion of the shaped charge 12 with an orienting weight 32, the necessity of additional length added to the string is avoided.

Figure 12:
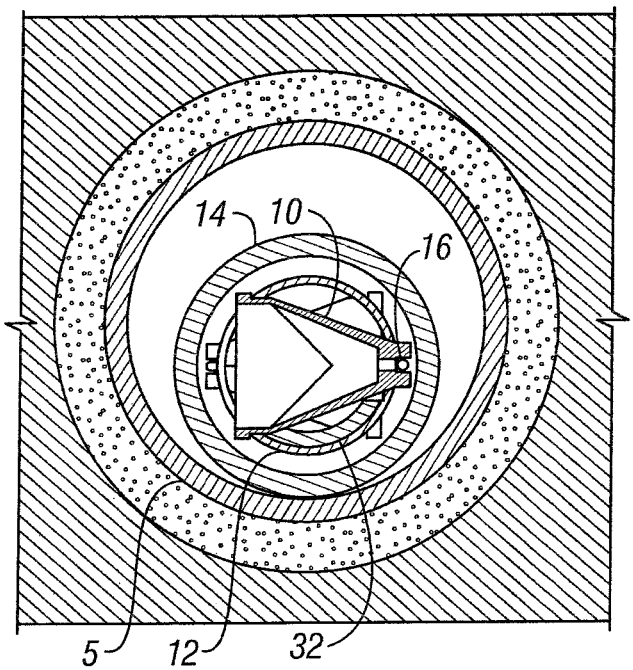
FIG. 12 is a cross-sectional view of the embodiment illustrated in FIG. 11.
Figure 13:
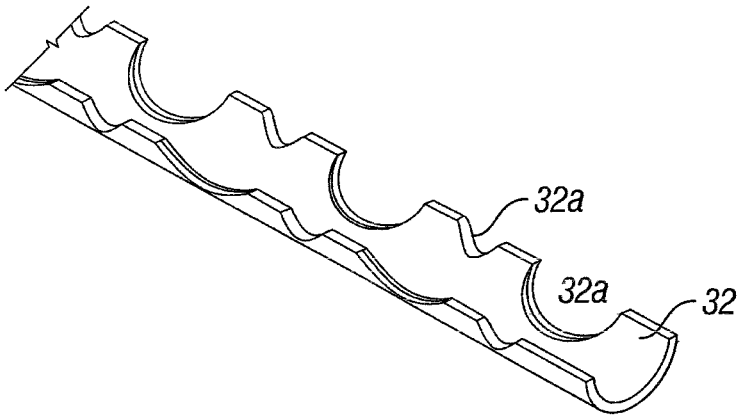
FIG. 13 is a perspective view of the orienting weight of FIGS. 11 and 12.

FIGS. 12 and 13 illustrate an embodiment of the perforating gun 1 having the loading tube 12 weighted around the shaped charges 10. FIG. 12 provides a cross-sectional view of the perforating gun 1, while FIG. 13 provides a perspective view of the orienting weight 32. As shown, the orienting weight 32 is configured and located such that the loading tube 12 and shaped charge 10 is oriented in a horizontal plane. The cutouts 32*a* in the orienting weight 32 match the pattern of the shaped charges 10 so that the orienting weight 32 does not interfere with either the charges 10 or the detonating cord 16.

While the above example illustrates use of the orienting weight 32 to perforate in a horizontal plane, it should be understood that the orienting weight 32 can be configured to provide orientation in any desired plane.

Another embodiment of the invention, illustrated in FIGS. 14-18, provides an articulated weight spacer 40 to provide correct orientation of the perforating gun throughout a tortured wellbore trajectory. As illustrated, the articulated weight spacer 40 comprises a semi-circular spacer tube 42 that is deployed within a hollow gun carrier 14 (shown in phantom lines in FIG. 1). However, in alternate embodiments, the articulated weight spacer 40 may take on any number of shapes.

The spacer tube 42 contains a plurality of jigsaw puzzle-like cuts 44 spaced along its length. The cuts 18 traverse the circumference of the tube 42 in such a way as to cut the spacer tube 42 into separate segments 46 without enabling the segments 46 to be disengaged from each other. The cuts 44 allow the spacer tube 42 to bend a little at each cut 44 without causing the spacer tube 42 to lose its structural properties and primary function (i.e., orienting the gun string in the right direction). The segments 46 at each end of the spacer tube 42 are attached to alignment plates 48 that are used to lock the articulated weight spacer 40 to the gun carrier 14 or gun string.

Figure 18A:
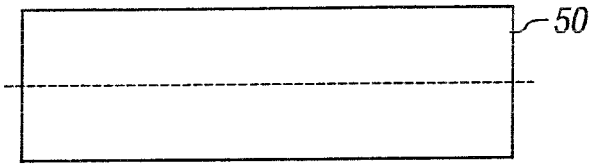
FIG. 18A-18C provides top, side, and end views of an embodiment of the shaped weight of the articulated weight spacer.
Figure 18B:
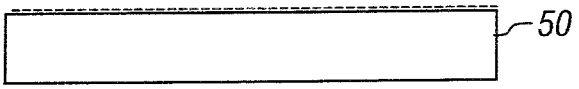
Figure 18C:
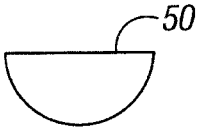

Within each segment 46 is an appropriately shaped weight 50 (best illustrated in FIGS. 18A-18C). The weights 50 orient the spacer 40 and thus the gun string in the desired orientation. In the embodiment shown in which the spacer tube 42 has a semi-circular shape, the weight 50 may also have a semi-circular shape enabling it to fit nicely within each segment 46. However, any number of shapes and types of weights remain within the scope of the invention. Each segment 46 may also include an end plate 56 at each of its ends to prevent the axial movement of the weight 50 within the spacer tube 42.

Figure 14:
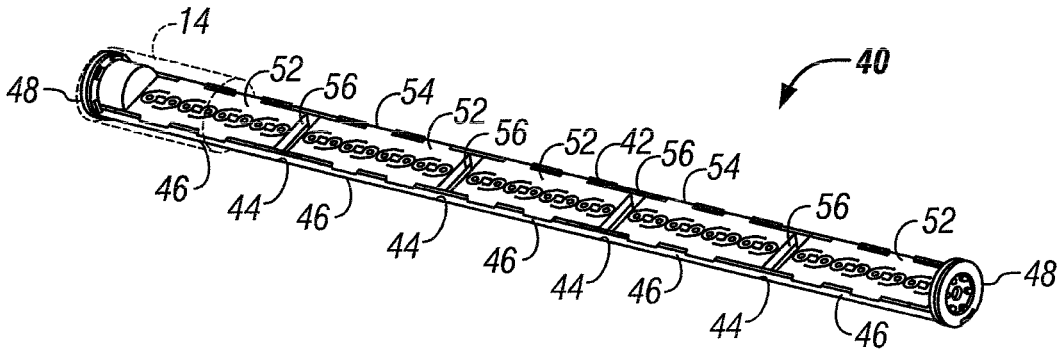
FIG. 14 is a perspective view of an embodiment of the articulated weight spacer of the present invention.
Figure 15:
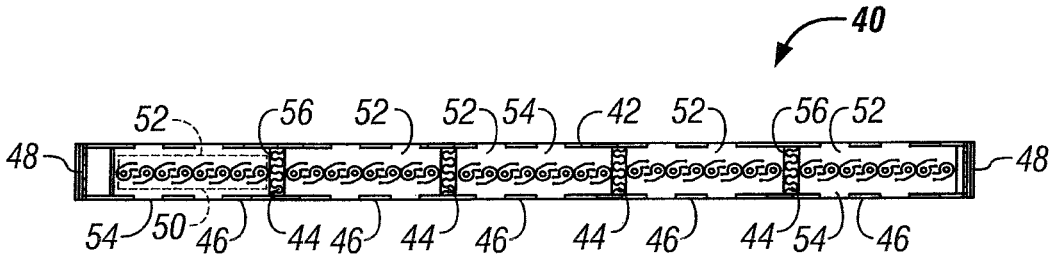
FIG. 15 is a top view of an embodiment of the articulated weight spacer of the present invention.
Figure 16:
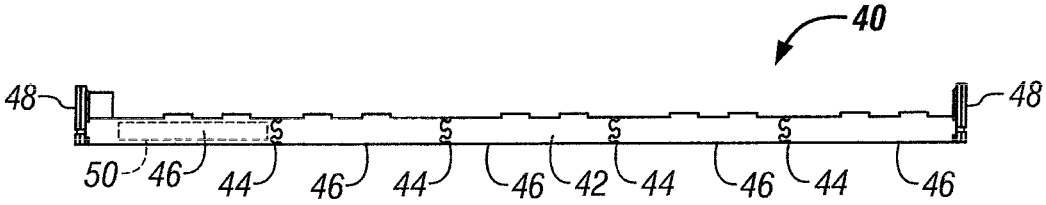
FIG. 16 is a side view of an embodiment of the articulated weight spacer of the present invention.
Figure 17:
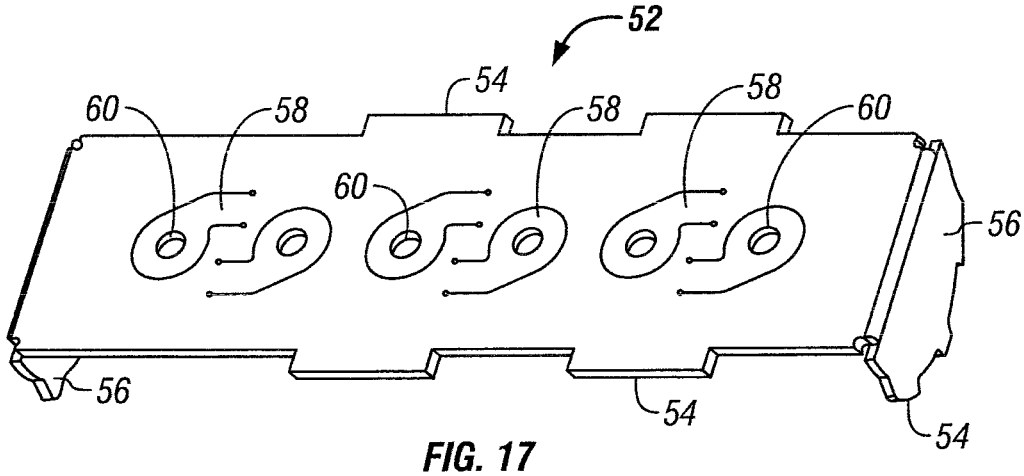
FIG. 17 is a perspective view of an embodiment of the cover of the articulated weight spacer.

As shown in FIGS. 14, 15, and 17, a cover 52 is attached to each segment 46 enclosing and securing the weight 50 therein. The cover can be connected to its corresponding segment 46 by the use of tabs 54 snapping into engaged to the segment 46, for example. Each cover 52 also has partially cut out tabs 58 that may be bent from the cover 52. Each tab 58 has an opening 60 therethrough sized for receipt of a detonating cord (not shown). When the gun string is assembled, the tabs 58 can be bent to extend away from the cover 52, and the detonating cord can be passed through each opening 60 to secure the detonating cord within the spacer 40.

The articulated weight spacer 40 does not contain a directionally preferred stiffness in bending. It has the same stiffness, or resistance to bending, or bending moment of inertia, in all directions. Although it will still provide a gravitational correcting torque to the gun string when the gun string is not oriented in the desired direction, the articulated weight spacer 40 will not rotate the guns out of the intended gravitationally preferred direction when the spacer assembly is bent in a non-straight wellbore (i.e., when the bend is not in the 6 or 12 o'clock plane).

Thus, by fabricating the spacer tube 42 in this manner, the segments 46 remain stiff while the spacer tube 42 as a whole is able to bend with no resistance in any direction. The quantity and length of segments 46 and the width of the cuts 44 can be chosen to allow a suitable bending radius. In this manner, the gun can be passed through a bent wellbore without concern that the spacer tube 42 will try to incorrectly orient the gun string.

Figure 19:
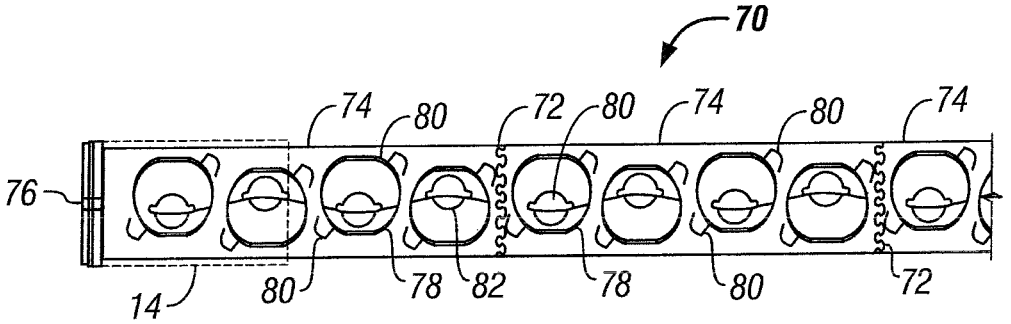
FIG. 19 is a top view of an embodiment of the articulated loading tube of the present invention.
Figure 20:
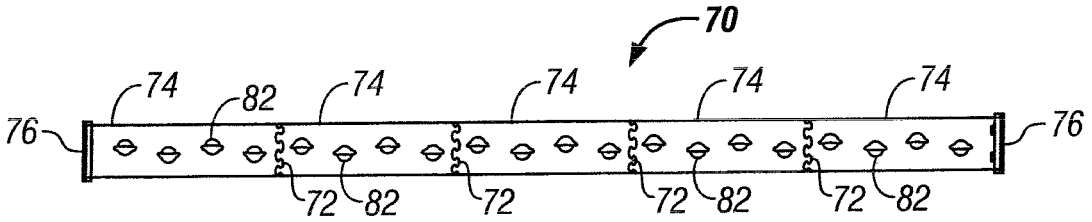
FIG. 20 is a top view of an embodiment of the articulated loading tube of the present invention.
Figure 21:
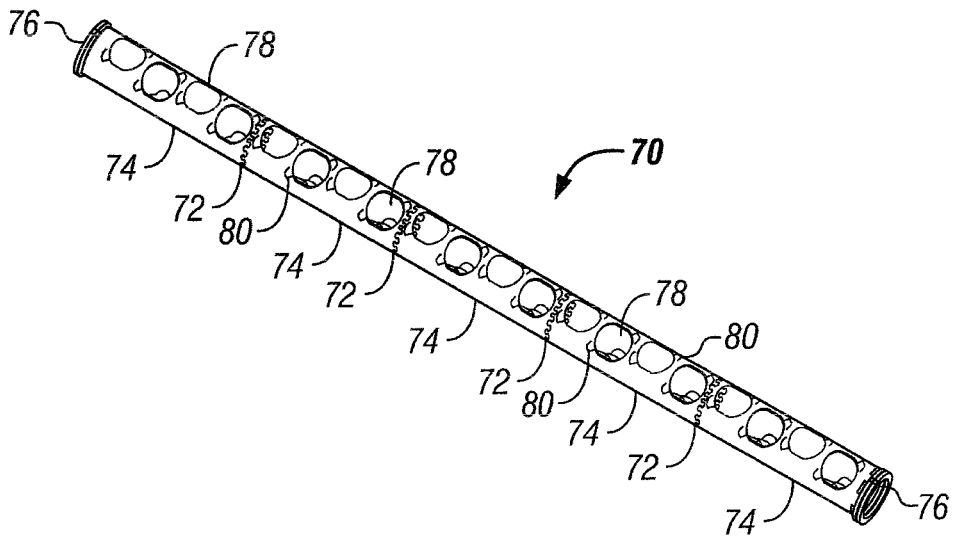
FIG. 21 is a perspective view of an embodiment of the articulated loading tube of the present invention.

FIG. 19-21 illustrates an embodiment of an articulated loading tube 70 that incorporates the principles of the articulated weight spacer 40 described above. The articulated loading tube 70, which is deployed within a hollow gun carrier 14 (shown in phantom lines in FIG. 19), contains a plurality of jigsaw puzzle-like cuts 72 spaced along its length. The cuts 72 traverse the circumference of the loading tube 70 in such a way as to cut the loading tube 70 into separate segments 74 without enabling the segments 74 to be disengaged from each other. The cuts 72 allow the loading tube 70 to bend a little at each cut 72 without causing the loading tube 70 to lose its structural properties and primary function (i.e., holding the shaped charges in their correct position inside the gun carrier 14). The segments 74 at each end of the loading tube 70 are attached to end plates 76 that are used to lock the articulated loading tube 70 to the gun string.

Each segment 74 may include a plurality of openings 78 for receipt of shaped charges (not shown). Tabs 80 may also be included in order to help secure the shaped charges in place. An opposing opening 82 may also be defined opposite each opening 78 for receipt of the back end of the corresponding shaped charge.

By fabricating the loading tube 70 in this manner, the individual segments 74 remain stiff while the loading tube 70 as a whole is able to bend with no resistance in any direction. The quantity and length of segments 74 and the width of the cuts 72 can be chosen to allow a suitable bending radius. In this manner, the gun can be passed through a bent wellbore without concern that the loading tube 70 will try to incorrectly orient the gun string.

Figure 22:
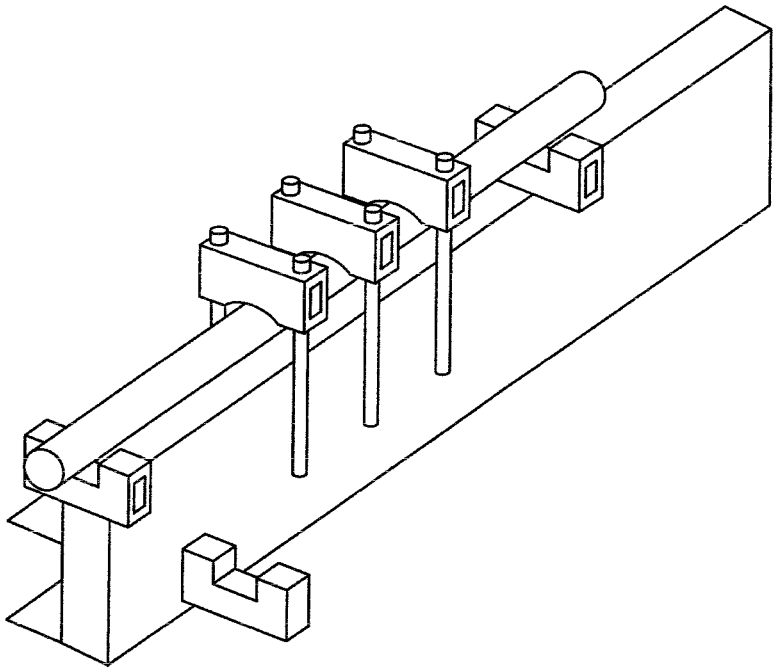
FIG. 22 is a perspective view of a "bent torque response" assembly.

Another embodiment of the present invention provides a method of compensating for non-uniformity of the bending moment in gun string components (i.e., gun carriers, gun spacers, and weighted housings). In this embodiment, a length of gun component raw material is bent in a curvature resembling that which may be experienced in a bent wellbore. While the material is bent, it is rotated about its longitudinal axis. The amount of torque required to accomplish the rotations is measured versus the angle of rotation between a reference "zero" and 360 degrees. Such measurement can be accomplished using a "bent torque response" assembly as illustrated in FIG. 22.

Figure 23:
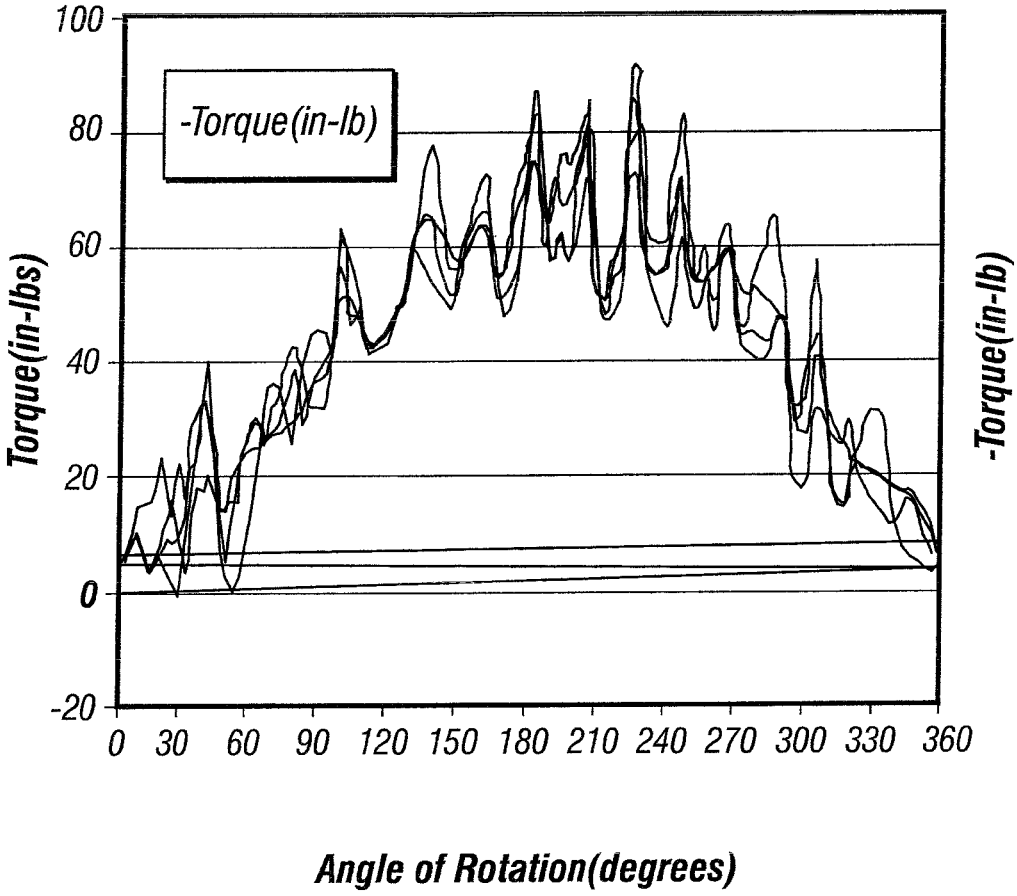
FIG. 23 is a plot representing torque versus angle of rotation.

FIG. 23 provides a graphical representation of the required torque plotted against the angle of rotation. The plot illustrates the effect that a non-uniform bending moment of inertia will have on the gun sting components. The "static" or resting position is described as the location where the torque, rotation plot crosses zero torque. Using the data, the "optimal angular position" is identified. This optimal angular position, referred to as the "bent torque zero angle," is the angle at which the component would actively orient itself along the inside curvature surface of the casing of the bent wellbore.

By knowing in advance the wellbore trajectory, and knowing the "angle of bend," gun carriers, gun spacers, and weighted spacer housings can be provided that will actively orient the gun string in the desired direction. The gun carriers, gun spacers, and weighted spacer housings that are known or planned to be located in a bent section can be manufactured to have the bent torque zero angle coincident with the angle of the bend of the bent wellbore.

The magnitude of the torque provided, or available, in the active orientation can be determined as well from the characterization of the raw material in the bent material torque response tests. The magnitude will vary depending on the individual piece of raw material the degree of bend, and the length of the bent portion of the wellbore. The longer the bent portion of the wellbore, the greater the active orienting torque available. The higher the bend angle in the wellbore, the greater the active orienting torque available. Finally, the greater the amount of torque required to rotate a piece of raw material through one revolution, as identified in the bent material torque response tests, the greater the active orienting torque available.

Another embodiment of the present invention provides a positive alignment carrier that removes alignment error in subsequent gun strings that exists due to machining tolerances and clearances.

In other words, the positive alignment carrier 90 illustrated in FIGS. 24-32 ensures that additional gun strings affixed to a first oriented gun string maintain the orientation of the first string.

Figure 24:
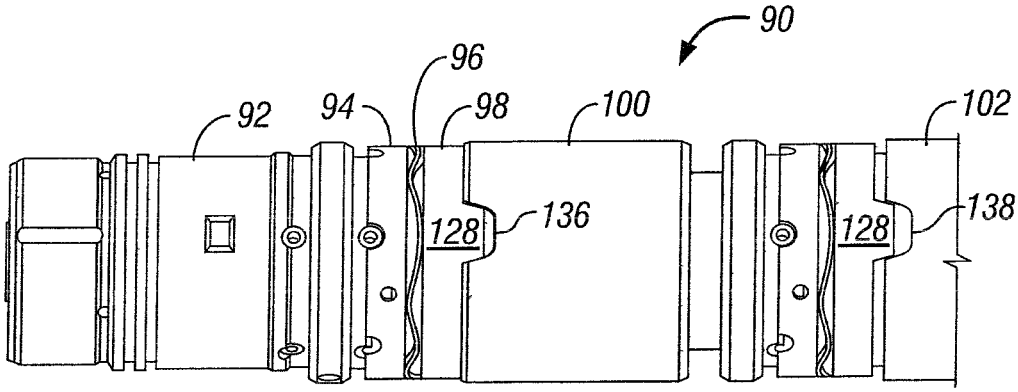
FIG. 24 is a perspective view of an embodiment of the positive alignment carrier of the present invention.

Referring first to FIG. 24 the positive alignment carrier 90 comprises an adapter 92, a shoulder ring 94, a spring ring 96, and a lock ring 98. As shown, the positive alignment carrier 90 is engaging both a second positive alignment carrier 100, and a downhole tool 102 such as an additional perforating gun carrier. The positive alignment carrier 90 can be used to advantage to engage any number of downhole string components, tools and pieces of downhole equipment.

Figure 25:
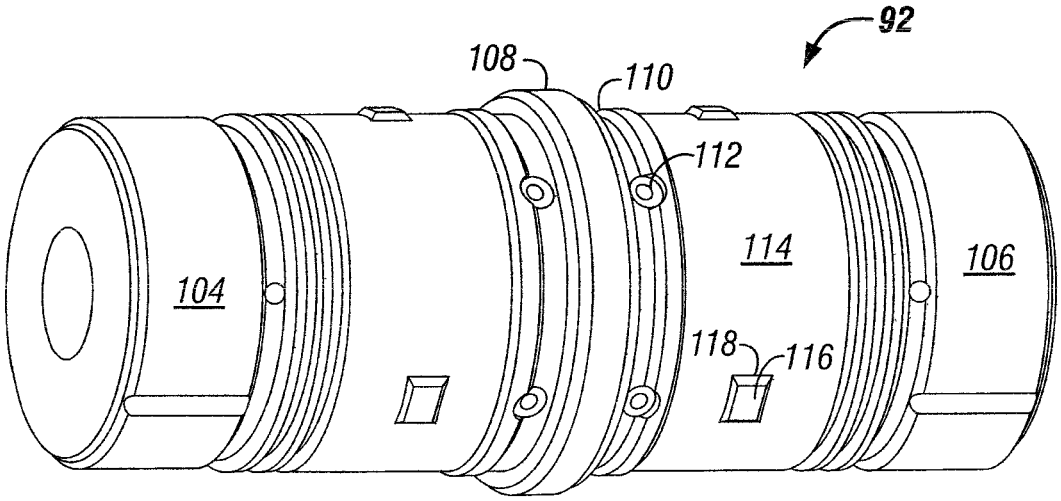
FIG. 25 is a perspective view of an embodiment of the adapter of the positive alignment carrier.

FIG. 25 provides a perspective view of an embodiment of the adapter 92 of the positive alignment carrier 90. In the embodiment shown, both ends 104, 106 of the adapter 92 can be used to positively align adjoining components. In alternate embodiments, one end of the adapter 92 can be integral with one of the adjoined components, or can be fixed to an adjoining component in a standard manner such as threading.

The adapter 92 has a shoulder 108 having threads 110. Proximate the threads 110 are a plurality of set screw receptacles 112. The set screw receptacles 112 are located around the circumference of the adapter 92. The adapter surface 114 is further defined by a plurality of tapered keys 116 that protrude from the adapter surface 114. The tapered keys 116 have tapered sides 118. In the embodiment shown, the tapered keys 116 are rectangular in shape. However, in alternate embodiments, the tapered keys 116 can take on any number of regular or irregular shapes.

Figure 26:
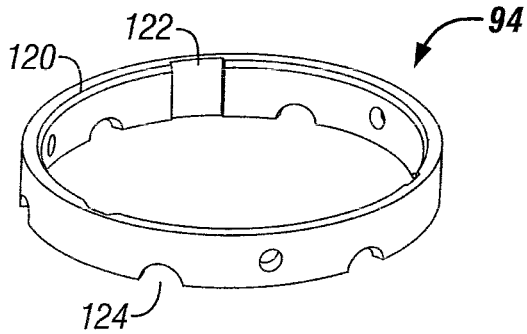
FIG. 26 is a perspective view of an embodiment of the shoulder ring of the positive alignment carrier.
Figure 27:
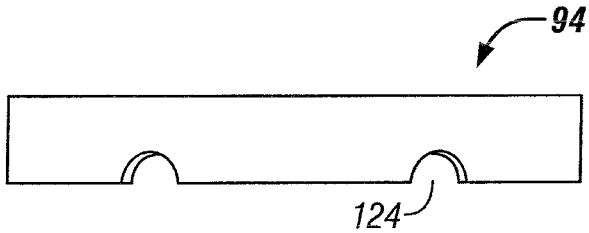
FIG. 27 is a side view of an embodiment of the shoulder ring of the positive alignment carrier.

Referring to FIGS. 26 and 27, the shoulder ring 94 is shown in perspective and side views. The internal diameter of the shoulder ring 94 is defined by a plurality of keyways 122 that correspond and align with the tapered keys 116 of the adapter 92. The keyways 122 enable the shoulder ring 94 to pass by the tapered keys 116 in either direction without interference. The interior of the shoulder ring 94 is further defined by threads 120 that can matingly engage the threads 110 of the adapter shoulder 108. A plurality of notches 124 are located around the circumference of the shoulder ring 94.

Figure 28:
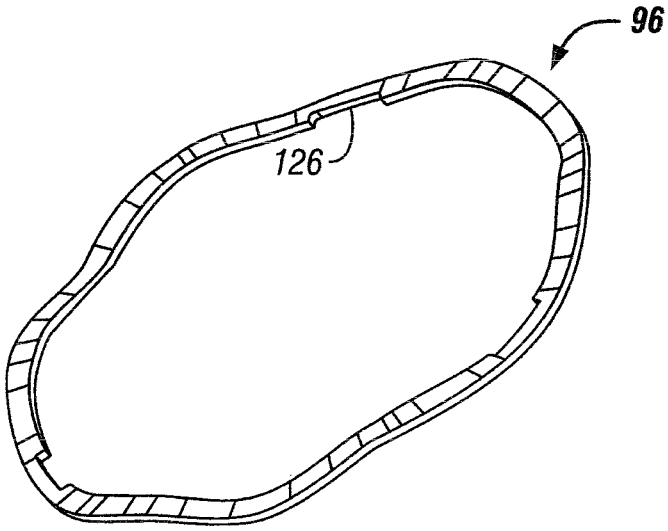
FIG. 28 is a perspective view of an embodiment of the spring ring of the positive alignment carrier.
Figure 29:
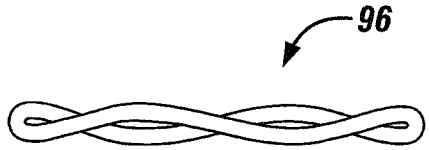
FIG. 29 provides a side view of an alternate embodiment of the spring ring of the positive alignment carrier.
Figure 30:
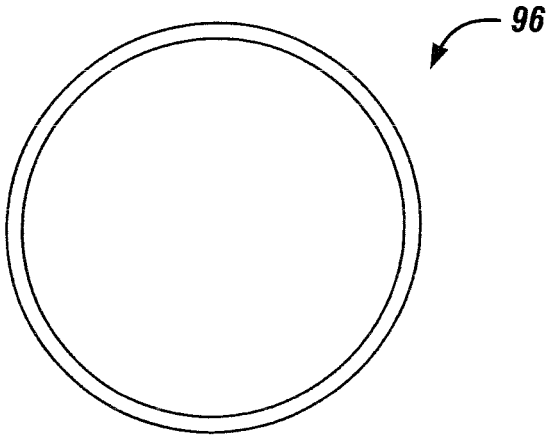
FIG. 30 provides a top view of an alternate embodiment of the spring ring of the positive alignment carrier.
Figure 31:
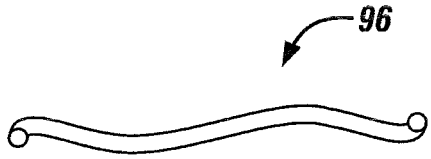
FIG. 31 provides a cut perspective view of an alternate embodiment of the spring ring.

Referring to FIG. 28, an embodiment of the spring ring 96 is shown in perspective view. The spring ring 96 is a conventional spring, such as a wave spring, that has a series of keyways 126 defined along its internal diameter that enable the spring 96 to pass over the tapered keys 116 of the adapter without interference. An alternate embodiment of the spring 96 is shown in FIG. 29-31.

Figure 32:
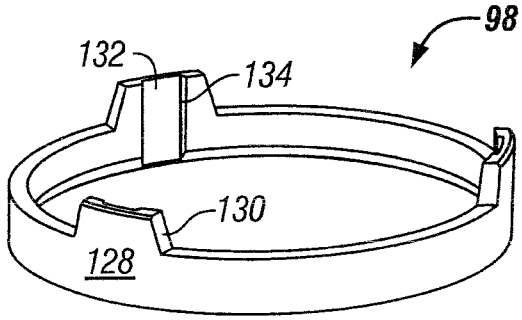
FIG. 32 is a perspective view of an embodiment of the locking ring of the positive alignment carrier.

FIG. 32 provides a perspective view of an embodiment of the locking ring 98. The locking ring 98 has a plurality of locking tabs 128 that protrude axially from the locking ring 98. The locking tabs 128 are defined by tapered surfaces 130. The locking tabs 128 are sized and shaped to engage corresponding tapered notches in the ends of gun carriers, spacers, other adapters, and other downhole components. The inner surface of the locking tabs 128 are key receptacles 132 having tapered sides 134. The key receptacles 132 are sized and shaped such that an interference exists between the tapered keys 116 and the key receptacles 132 at all times as the locking ring 98 is maneuvered across the tapered keys 116. Thus, the locking ring 98 must deform to fit over the adapter 92 removing all clearance between the two.

In operation, the shoulder ring 94 is first maneuvered along the adapter 92 toward the threaded shoulder 108. The shoulder ring 94 is able to pass by the tapered keys 116 by aligning the keyways 122 with the tapered keys 116. After passing the tapered keys 116, the shoulder ring is threaded onto the threads 116 of the shoulder 108. The spring ring 96 is then maneuvered onto the adapter and located in proximity of the shoulder ring 94.

After the spring ring 96 is placed on the adapter 92, the locking ring 98 is maneuvered onto the adapter 92 such that the key receptacles 132 engage the tapered keys 116. As stated above, there exists an interference between the tapered keys 116 and the key receptacles 132 such that the locking ring 98 must deform to fit over the adapter 92. Such deformation removes any clearance between the two.

Once the locking ring 98 is positioned over the tapered keys 116, the locking ring 98 is held in place by the shoulder ring 94 and spring ring 96. The shoulder ring 94 is backed off of the threads 116 of the adapter shoulder 108 until the spring ring 96 is acting on the locking ring 98 with the desired force. Once the desired force is attained, set screws are inserted through the notches 124 of shoulder ring 94 into the set screw receptacles 112 in the adapter. The set screws maintain the position of the shoulder ring 94, which in turn maintains the force supplied by the spring ring 96 on the locking ring 98. The spring ring 96 acts to hold the locking ring 98 in place, but also acts to absorb the forces generated by any axial displacement of the locking ring 98 toward the shoulder ring 94. Such axial displacement can occur during downhole operations.

In an alternate embodiment, the shoulder ring 94 is backed off of the threads 116 of the adapter shoulder 108 until the shoulder ring 94 is in abutment with the locking ring 98. Thus, the spring ring 96 is not needed. However, any axial displacement or axial forces acting on the locking ring 98 must be carried by the set screws and/or threads 110 of the shoulder ring 94.

Once the locking ring 98 is secured in place over the tapered keys 116, the mating component (gun carrier, spacer, adapter, etc.) can be attached. As shown in FIG. 24, the mating component (100 or 102) has tapered notches 136, 138 that are engaged by the locking tabs 128 on the locking ring 98. The tapered notches 136, 138, have tapered surfaces that facilitate a secure engagement with the tapered surfaces 130 of the locking tabs 128.

The locking ring 98 is positively aligned and secured by both the interaction between the keyways 132 and the tapered keys 116 and the action of the shoulder ring 94. The mating component (gun carrier, spacer, adapter, etc.) is positively aligned and secured by engagement with the locking tabs 128 on the locking ring 98. Consequently, manufacturing tolerances are eliminated and the connection is positively aligned. Duplicating this type of connection throughout an entire string assembly results in a string assembly that does not have a gradual "drift" of alignment.

Figure 33:
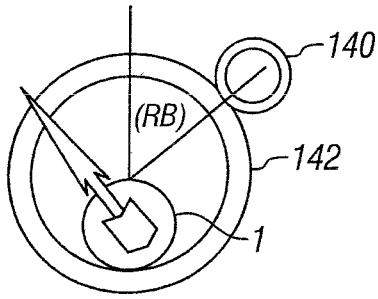
FIG. 33 is a top view schematic of a typical casing/control line configuration indicating the relative bearing and the direction of perforation.

Another embodiment of the present invention provides a system and method of detecting control lines (acoustic, electrical, nuclear, thermal, magnetic, etc.) based on the detection of various materials contained therein. As illustrated in FIG. 33, by detecting the control line 140 with one sensor and at the same time mapping its position with respect to a fixed position in the casing 142 (e.g. Relative Bearing (RB) to the high side or low side of the hole) the information needed to position the perforating guns 1 in the desired direction is provided. As shown in the illustration, the control line 140 is mapped with respect to the high side RB, and the perforating gun 1 is oriented and fired in a direction (indicated by the arrow) that avoids any interference with the control line 140.

It is important to note, that the system and method is equally applicable to downhole sensors, controls, downhole equipment and downhole tools that can be damaged or affected if in or near the path of a shaped charge jet. For ease of discussion, however, the invention will be discussed with reference to control lines.

In one embodiment of the system and method for detecting control lines 140 (and other components), the control line 140 is mapped and the gun 1 is indexed during the same trip in the hole. In this embodiment, focused detector(s) are used to determine the position of the control line 140, and a gyro is used in conjunction with the detector(s) to map the position of the control line 140 with respect to the low or high side of the casing 142. Once this is determined a gun string with an inclinometer/relative bearing tool (Wireline Perforating Inclinometer Tool) and gyro is run in the hole. This is used to verify that the inclinometer/relative bearing tool is in agreement with the gyro (required for wells with small inclinations). During the shooting pass the guns 1 and inclinometer/relative bearing tool are run (the gyro tool is removed) with the gun 1 positioned in the desired shooting direction. The inclinometer/relative bearing tool is used to confirm that the gun 1 is positioned in the desired direction and the guns 1 are fired. The guns 1 can be oriented by any of the above mentioned methods, Further, the guns can be positioned by conventional passive means (Wireline Oriented Perforating Tool, Weighted Spring Positioning Device) or active means (downhole motor—Wireline Perforating Platform).

The focused detector(s) are selected based upon what the control lines 140 (or other components) are made of or contain within. In one embodiment, the method and system uses radioactive detection. In this embodiment, a gamma ray imaging tool is used to detect the control line 140 or any component in the control line 140 that is doped with radioactive tracer elements (cobalt 60, cesium, etc.). Likewise, the gamma ray imaging tool can be used to detect a radioactive pip tag placed in the brackets that fasten the control line 140 to the casing/tubing. The gamma ray imaging tool can also be used to detect radioactive fluid injected into the control line 140.

In another embodiment of the system and method of detecting control lines 140, the detector(s) are used for acoustic detection. Ultrasonic imaging tools can be used if the control line 140 has a significant difference in acoustic impedance from the surrounding media (cement, mud cake, formation, gravel pack, etc.).

In yet another embodiment of the system and method of detecting control lines 140, the focused detector(s) are used for thermal detection. In this embodiment, thermal detection tools (Production Services Platform, Manometer Temperature Sonde) can be used to detect cooling fluid that is pumped down the control line 140.

Still another embodiment of the system and method of detecting control lines 140 utilizes electrical detection. In this embodiment, the control line 140 is detected where the coupling of an induced EMF signal on the control line side of the casing 142 differs from the opposite side. Alternately smart card type transducers, or other electronic tags, can be oriented in the casing 142 or control line 140 and detected.

Another embodiment of the system and method of detecting control lines 140 uses magnetic detection. A Magnetometer can be used when a magnetic tag is placed in the control line 140, control line brackets or the casing 142.

Figure 34:
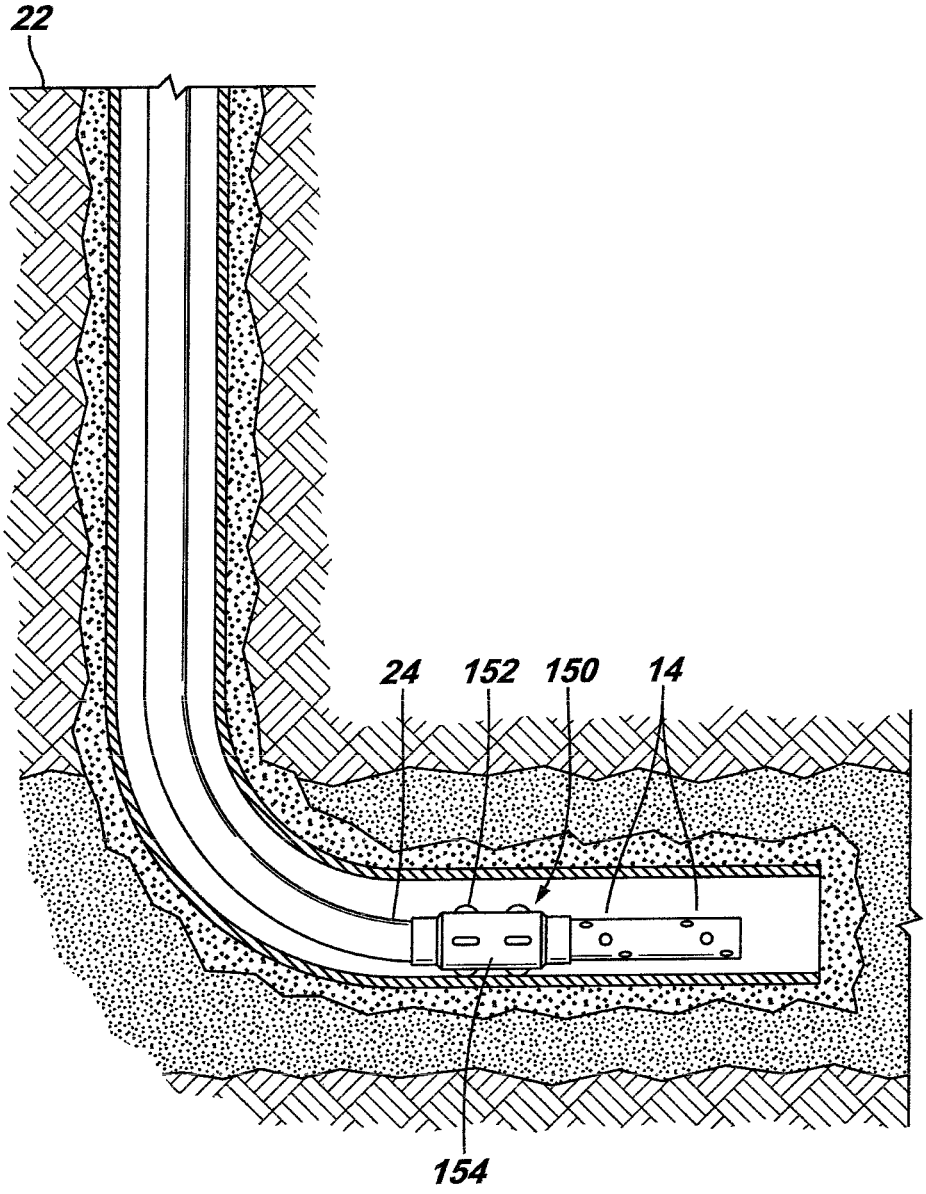
FIG. 34 provides a side view schematic of an embodiment of the present invention having a roller adapter adapted to facilitate conveyance of a gun string.

Another embodiment of the present invention, illustrated schematically in FIG. 34, provides a roller adapter 150 adapted to facilitate conveyance of a gun string 14 downhole. As shown, the roller adapter 150 is provided intermediate the tool string 24 and the gun string 14. To reduce the friction of the gun string 14 during conveyance, the roller adapter 150 provides a plurality of roller wheels 152 housed within a roller cage 154. To enable the gun string 14 to orient itself independently and properly in the wellbore 22, the roller adapter 150 allows the gun string 14 to rotate independently from the roller cage 154.

Figure 35:
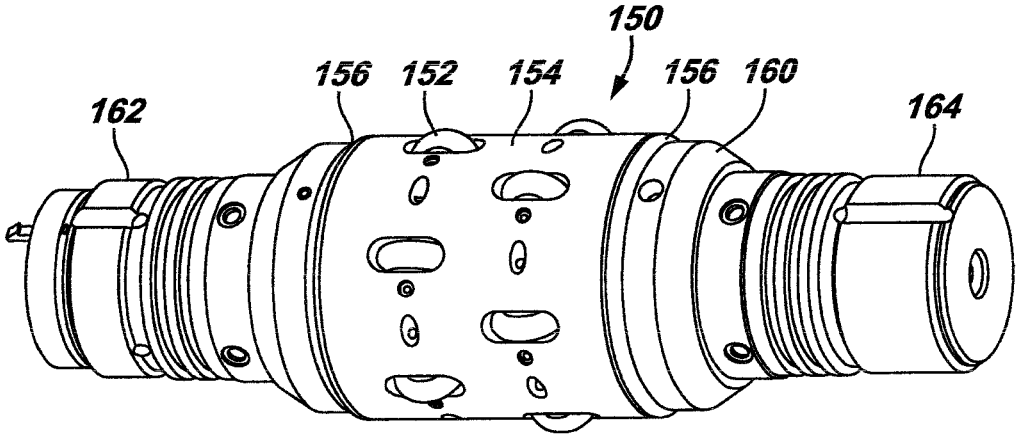
FIG. 35 provides a perspective view of an embodiment of the roller adapter of the present invention.
Figure 36:
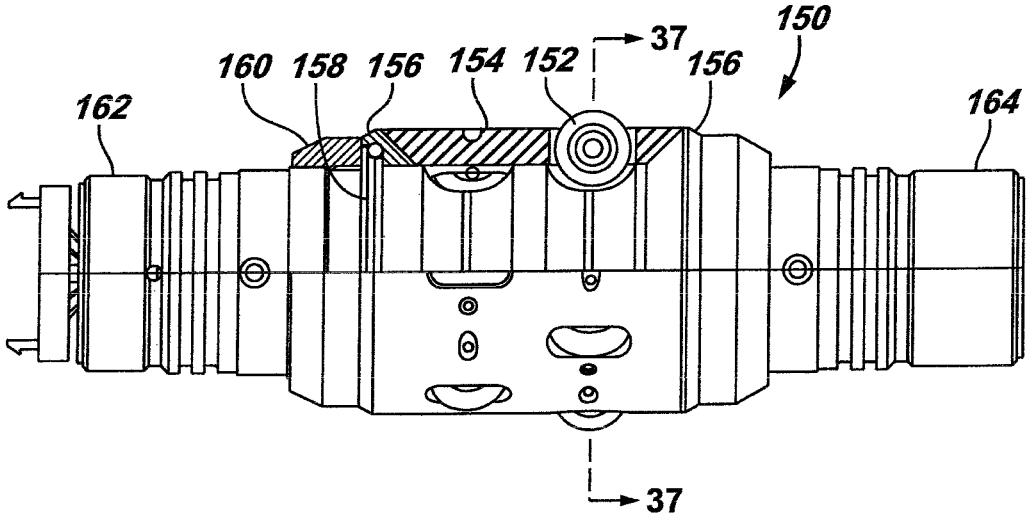
FIG. 36 provides a partial section view of an embodiment of the roller adapter of the present invention.
Figure 37:
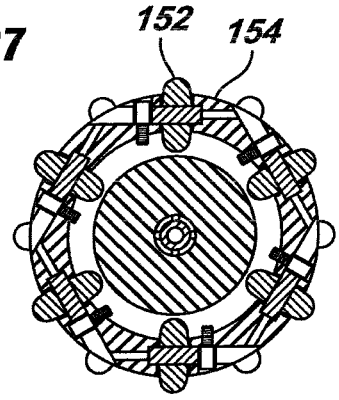
FIG. 37 provides a cross-sectional view of an embodiment of the roller adapter of the present invention taken along the line 37-37 of FIG. 36.

The roller adapter 150 is described in more detail with reference to FIGS. 35 through 37. FIG. 35 provides a perspective view of the roller adapter 150, FIG. 36 provides a partial section view of the roller adapter 150, and FIG. 37 provides a cross-sectional view of the roller adapter 150 taken along the line 37-37 of FIG. 36.

The roller adapter 150 provides a plurality of roller wheels 152 housed within a roller cage 154. The roller wheels 152 are aligned along the longitudinal axis of the roller adapter 150 and are spaced around the circumference of the roller cage 154. It should be noted that any number of roller wheels 152 can be provided with any number of circumferential configurations. It should also be noted that the wheels 152 can be replaced with similar rotational devices, such as ball bearings, rollers, or balls, and remain within the scope of the invention.

As mentioned above, the roller wheels 152 reduce the friction of the gun string 14 during conveyance. The roller wheels 152 eliminate the necessity of overcoming the sliding friction experienced by the gun string 14 as it is positioned within the wellbore 22. This reduction in friction is particularly advantageous in extended reach wells or when the gun string 14 is being conveyed with coiled tubing.

The roller cage 154 that houses the roller wheels 152 is mounted between two hearing race assemblies 156. The axial position of the bearing race assemblies 156, and thus the roller cage 154, is maintained by cage retainers 160. The bearing race assemblies 156 each contain rollers 158 that enable the roller cage 154 to spin with very little friction. In one embodiment, the rollers 158 each contain two sizes of ball bearings. The ability of the cage 154 to spin freely ensures that the rollers 158 do not act to rotate the gun string during conveyance into the wellbore. Such unwanted rotation could introduce gun string orientation errors.

The roller adapter 150 is connected intermediate the tool string 24 and the gun string 14 by adapters 162, 164 located at opposite ends of the roller adapter 150. The adapters 162, 164 can take on any number of embodiments depending upon the mating ends of the components to be connected.

Another embodiment of the present invention provides a bearing isolation device adapted to increase the load carrying capacity of swivels utilized by the gun string. Swivels are used in the gun string to enable the perforating guns to rotate independent of the tool string to achieve the desired orientation. Referring back to FIG. 10, a swivel 26 is positioned intermediate the tool string 24 and the gun string 14. FIG. 10 illustrates an orienting device utilizing weights 28, 30 conveyed with the gun string 14. It should be understood that the orienting device conveyed with the gun string can be any number of devices, including any of the aforementioned embodiments of the present invention.

Figure 38:
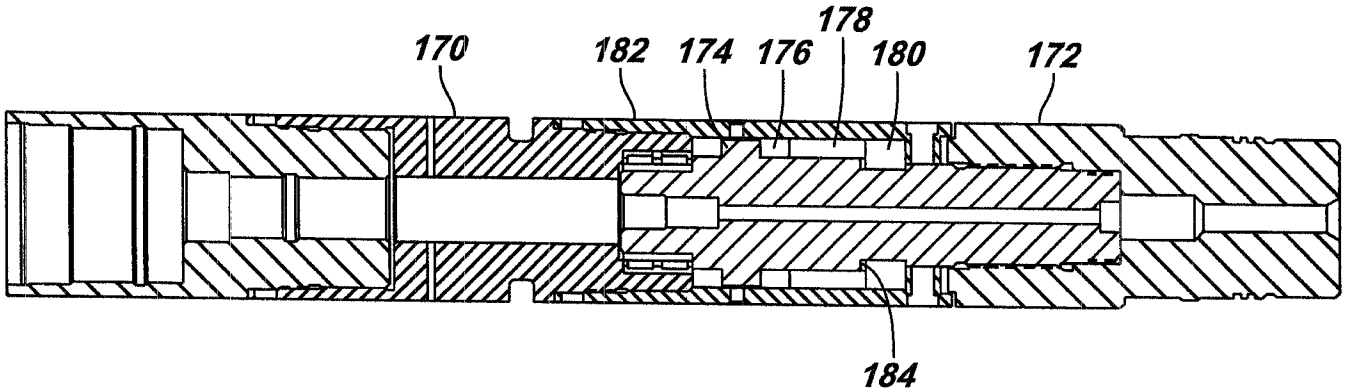
FIG. 38 illustrates an embodiment of the present invention having a swivel with a bearing isolation device, shown in its unloaded state.
Figure 39:
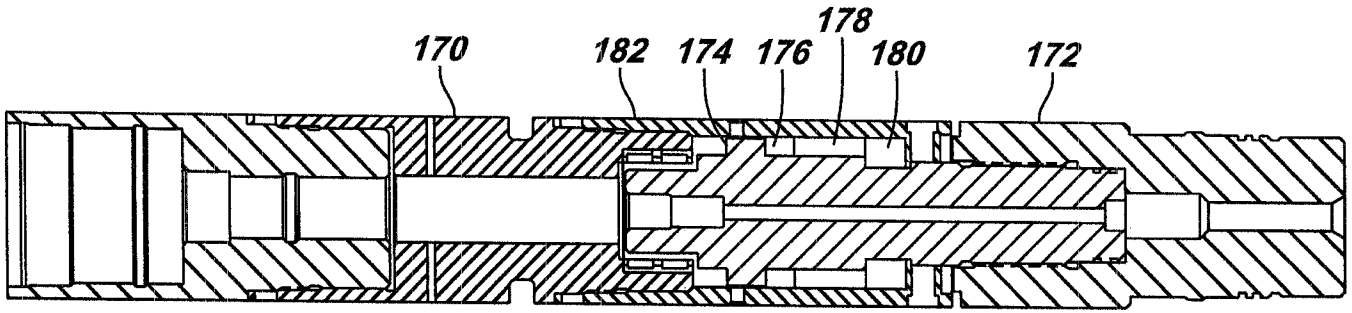
FIG. 39 illustrates an embodiment of the present invention having a swivel with a bearing isolation device, shown in its loaded state.

FIGS. 38 and 39 illustrate an embodiment of a swivel having a bearing isolation device of the present invention. In FIG. 38, the swivel is shown in its unloaded state, and in FIG. 39, the swivel is shown in its loaded state. The swivel has an upper adapter 170 provided for connection to a tool string, and has a lower adapter 172 provided for connection to a perforating gun. Housed within the lower adapter 172 is a rotatable shaft 174 that enables a perforating gun to rotate without imparting the rotation to the tool string. Thus, the perforating gun can rotate to the desired orientation independent of the tool string.

The bearing isolation device utilized by the swivel is generally comprised of a thrust bearing 176, a bearing floater 178 and a split ring 180, all housed within a collar 182. The thrust bearing 176 is a roller type bearing that, in general, is relatively limited with respect to its maximum load. At high loads, such as those experienced during deployment of a long and heavy gun string, the rollers and washers of the thrust bearing 176 can become damaged. Such damage can result in an increase of the torque required to rotate the shaft 174.

Figure 40:
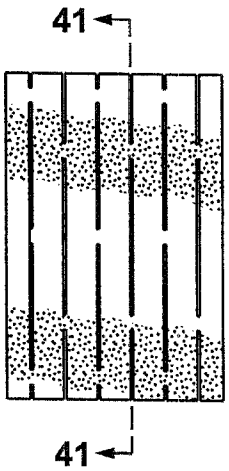
FIG. 40 provides a side view of an embodiment of the bearing floater used in the swivel having a bearing device.
Figure 41:
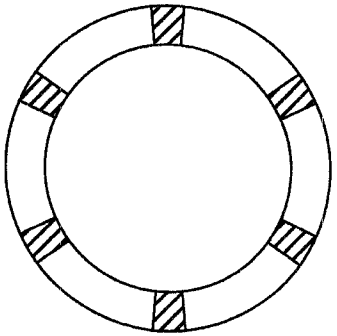
FIG. 41 is a cross-sectional view schematic of the bearing floater of FIG. 40 taken along the line 40-40.

The bearing floater 178 is provided to prevent such damage to the rollers and washers of the thrust bearing 176. The bearing floater 178 is a spring device that allows for predetermined deflection for a known compressive load. One embodiment of the bearing floater 178 is shown in FIGS. 40 (side view) and 41 (cross-sectional view). In the embodiment shown, the bearing floater 178 is a slotted cylinder enabling a small amount of deflection under a high load.

Referring back to FIGS. 38 and 39, the operation of the bearing isolation device is described. As the tensile load is applied through the lower adapter 172 and the shaft 174, the thrust bearing will see the load and transfer it through the bearing floater 178 and the split ring 180 to the collar 182. As the tensile load is increased, the bearing floater 178 compresses until the gap 184 between the shaft 174 and the split ring 180 is closed, at which point the load is transferred directly from the shaft 174 to the split ring 180 to the collar 182. In this manner, the rollers and washers of the thrust bearing 176 remain undamaged due to the high loads. The undamaged rollers and washers can operate with minimal friction/torque resistance and allow the gun string to be oriented correctly in the wellbore.

Figure 42:
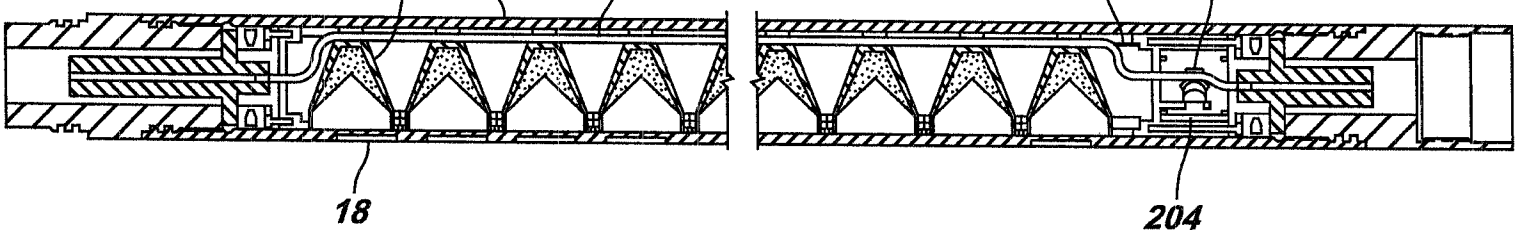
FIG. 42 is a side view of an embodiment of the confirmation device of the present invention.
Figure 43:
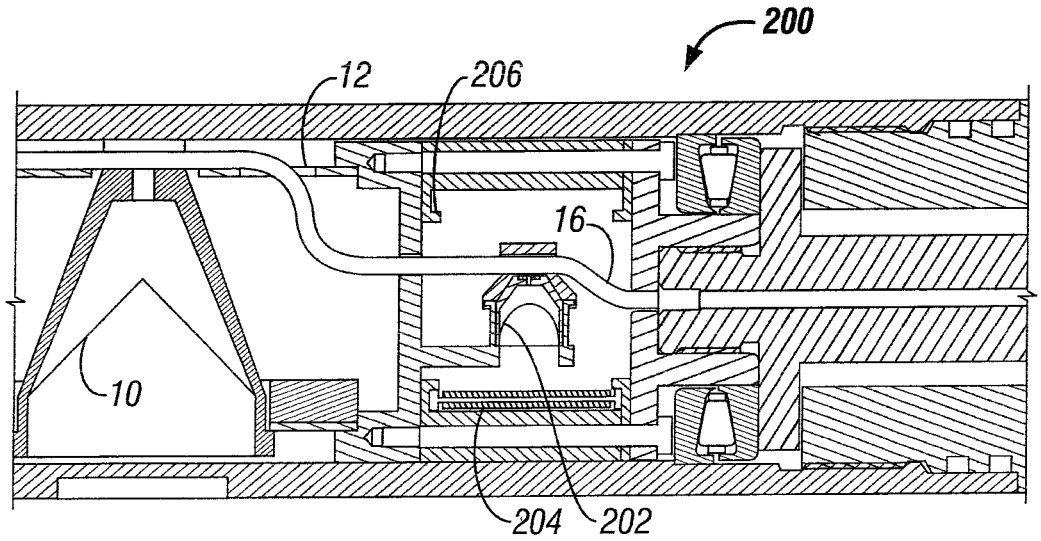
FIG. 43 is an enlarged side view of the confirmation device illustrated in FIG. 42.
Figure 44:
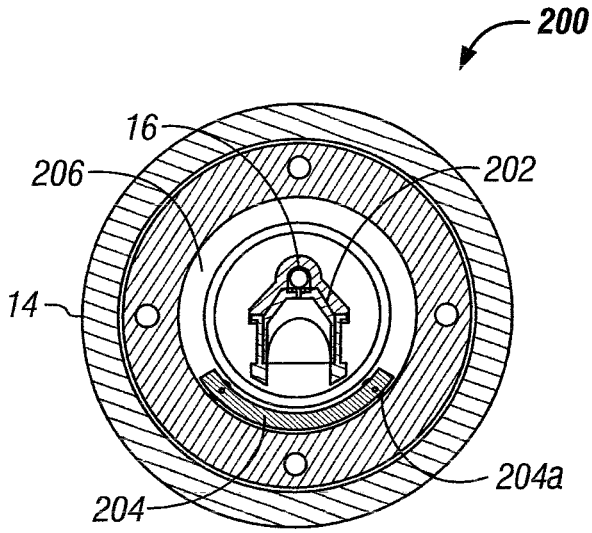
FIG. 44 is a cross-sectional view of the confirmation device illustrated in FIG. 42.

Another embodiment of the present invention provides an apparatus and method of confirming that a correct orientation of the perforating gun 1 has been achieved. As shown in FIGS. 42-44, the confirmation device 200 is housed within the gun carrier 14 and affixed to the loading tube 12. It should be noted that in alternate embodiments, it is not necessary that the confirmation device 200 be affixed to the loading tube 12, as long as the confirmation device 200 is attached to the gun string at a fixed angle with respect to the orientation of the shaped charges 10.

The confirmation device 200 provides a trigger charge (small shaped charge) 202 that is initiated by the same detonating cord 16 that initiates the main shaped charges 10. Upon detonation, the trigger charge 202 shoots into a proof plate 204 to provide evidence of the gun 1 orientation at the time of firing. The evidence is provided without piercing the gun carrier 14 and risking damage to the wellbore or wellbore components.

In the illustrated embodiment, the proof plate 204 is a semi-circular plate housed within a highly polished track 206. The proof plate 204 has one or more wheels 204*a* that enable the plate 204 to rotate, within the track 206, around the center axis of the gun 1. Due to its own weight, the proof plate 204 will always be on the bottom side of the well. The trigger charge 202 is positioned to shoot straight down relative to the correct orientation of the loading tube 12 and main charges 10 (whether at 0, 90, 180, or any other deviated angle) when properly oriented. Thus, if the orientation of the loading tube 12 is correct, the trigger charge 202 will always shoot straight through the center of the proof plate 204. If the charges 10 are not correctly oriented, the degree of misalignment can be measured by the shot fired into the proof plate 204.

It should be noted that in alternate embodiments, the proof plate 204 can be manufactured to extend completely around the trigger charge 202 and still be ordinated by gravity to record slight and large deviations.

Figure 45A:
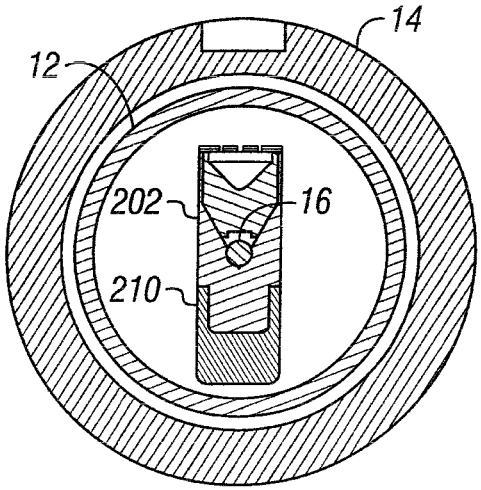
FIGS. 45A and 45B illustrate another embodiment of the confirmation device of the present invention.
Figure 45B:
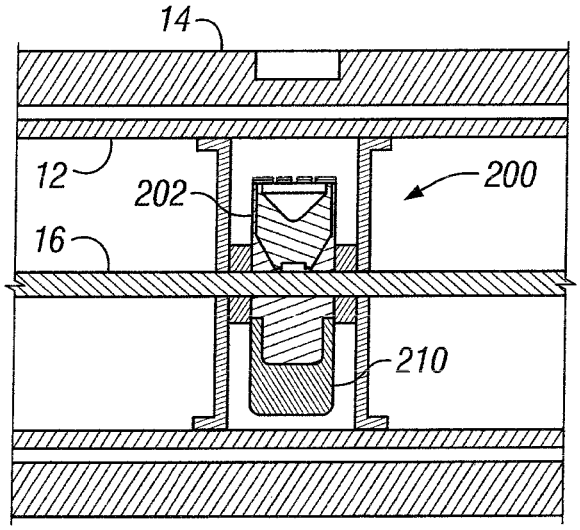

In another embodiment of the confirmation device 200, illustrated in FIGS. 45A and 45B, the trigger charge 202 is positioned in a rotating support 208 housed within the loading tube 12. The support 208 has a counter weight 210 thereon that biases the support 208 such that the weight 210 is oriented toward a lower position. In the embodiment shown, the trigger charge 202 faces opposite the counter weight 210 such that the trigger charge 202 is always oriented in an upward direction (although in other embodiments it could point in other directions).

The detonating cord 16 is provided in operable attachment to the trigger charge 202 such that detonation of the detonating cord causes the trigger charge 202 to fire. Upon detonation, the trigger charge 202 fires creating an indication on the loading tube 12 that can be inspected to determine the orientation of the perforations. Once again, the orientation is confirmed without the necessity of penetrating the gun carrier 14 with the trigger charge 202.

Figure 46:
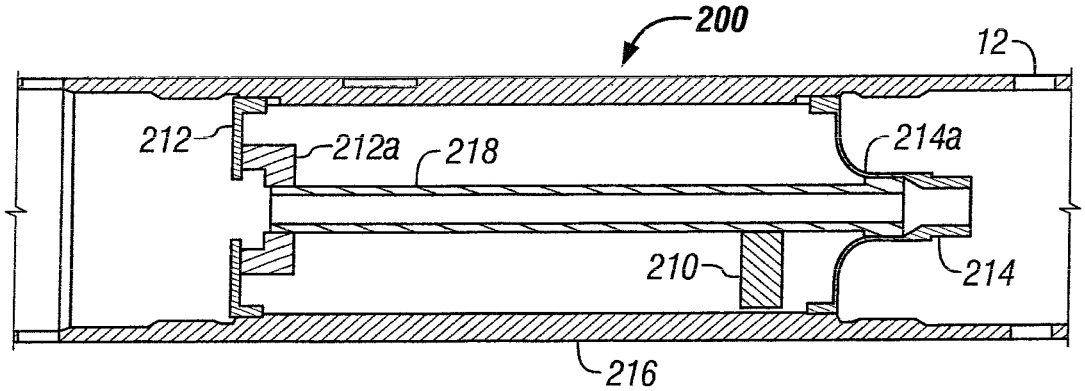
FIG. 46 illustrates another embodiment of the confirmation device of the present invention.

Another embodiment of confirming that a correct orientation of the perforating gun 1 has been achieved is illustrated in FIG. 46. In this embodiment, the confirmation device 200 is affixed to the loading tube 12 (as shown), housed within the loading tube 12, or attached to the gun string in fixed relation to the shaped charges (not shown). The confirmation device 200 can be located inside a space protected from damage from the firing of the shaped charges (not shown) such as spacer subs, trapped pressure regulators, swivels, etc.

The confirmation device 200 has an upper alignment plate 212 and a lower alignment plate 214 rigidly affixed within an external housing 216. The upper alignment plate 212 and the lower alignment plate 214 each provide a centralized guide 212*a*, 214*a*, for receipt of a central shaft 218. The guides 212*a*, 214*a* allow the central shaft 218 to rotate freely at both ends. Fixedly attached to the central shaft 218 is a counter weight 210 that is always positioned in the lower portion of the confirmation device 200 due to the force of gravity.

The detonating cord 16 passes through the central shaft 218. Upon detonation of the detonating cord 16 to fire the shaped charges (not shown), the pressure inside the central shaft 218 rises quickly causing the central shaft 218 to expand and lock itself inside the upper and lower guides 212*a*, 214*a*. Thus, the central shaft 218 is locked in the position it was in upon firing of the shaped charges. Upon retrieval of the gun string, the position of the central shaft 218 within the confirming device 200 can be examined to determine the orientation of the gun string at the time of detonation.

It should be noted that it is only necessary that the central shaft 218 expand to lock with one of the guides 212*a*, 214*a*. For example, the lower guide 212*a* may be made of plastic and only used for guiding purposes rather than locking purposes. It should further be noted that the guides 212*a*, 214*a* can include uneven surfaces that mechanically lock the central shaft 218 so as to not rely on friction alone to maintain the locked position.

Figure 47:
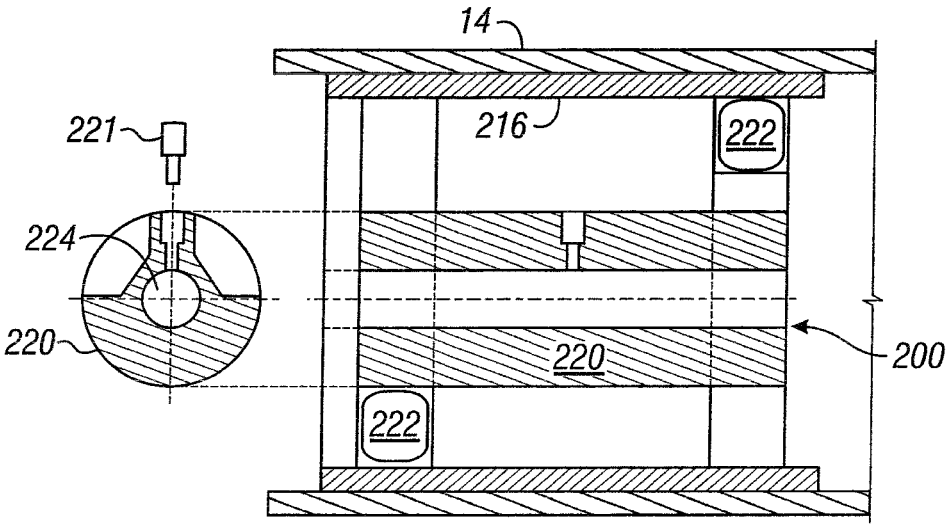
FIG. 47 illustrates another embodiment of the confirmation device of the present invention.

Yet another embodiment of the confirmation device 200 is illustrated in FIG. 47. In this embodiment, the confirmation device 200 is once again attached within the gun string in fixed relation to the orientation of the shaped charges. The external housing 216 of the confirmation device 200 is again affixed to an upper alignment plate (not shown). Within the external housing 216 is a confirming weight 220 held in position by two roller bearings 222. The confirming weight 220 provides a hardened spear 221 and is shaped such that it will preferentially, by means of gravity, orient itself on the lower side of the confirmation device 220 and point the spear 221 in the upward direction. The detonating cord (not shown) passes through the center drill hole 224 of the confirming weight 220.

Upon detonation of the detonating cord, the pressure rises rapidly within the drill hole 224 causing the spear 221 to be driven upward. The hardened spear 221 strikes and indents the inside surface of the external housing 216 at the time of detonation. After the perforating job is completed, the external housing 216 is removed and examined to determine the actual orientation of the perforations in the wellbore.

Figure 48:
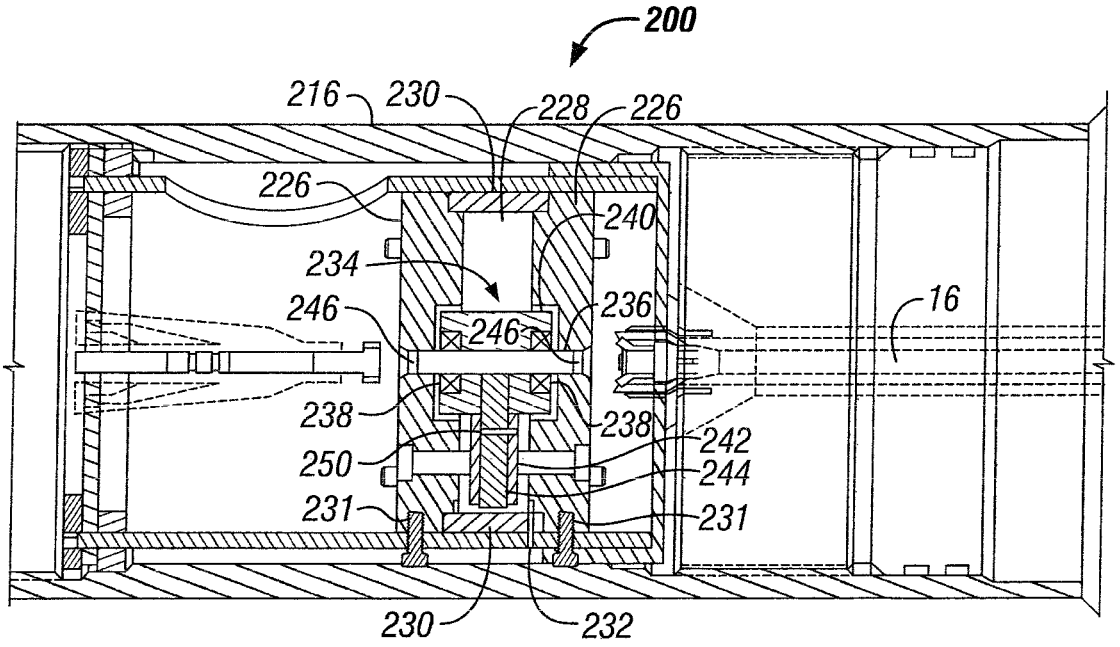
FIG. 48 illustrates another embodiment of the confirmation device of the present invention.

Another embodiment of the confirmation device 200 is illustrated in FIG. 48. Once again, the confirmation device 200 is attached within the gun string in fixed relation to the orientation of the shaped charges. In this embodiment, the confirmation device 200 includes two disks 226 with a gap 228 defined therebetween. A sleeve 230 is disposed circumferentially between the disks 226. The disks 226 and sleeve 230 are fixed in relation to the external housing 216 such as by screws 231, or pins 232, for example.

A spear mechanism 234 provides a tube 236, two bearings 238, a hub 240, a barrel 242, and a spear 244. The tube 236 is positioned within the central openings 246 defined through the disks 226. The bearings 238 are mounted on the tube 236 on either side of the hub 240, with the tube 236 also passing through the central opening 248 in the hub 240. The bearings 238 enable rotation of the hub 240. The barrel 242 extends from the hub 240 and is in communication with the central opening 248. The spear 244 is located within the barrel 242 and may be initially held in place by a shear pin 250. The spear mechanism 234 is weighted, such as by the inclusion of the barrel 242 and spear 244, such that the barrel 242 and spear 244 are oriented, by gravity, on the lower side of the gun string.

The detonating cord 16 (shown in dashed lines) passes through the central openings 246 in the disks 226 and through the interior of the tube 236. Upon detonation of the detonating cord 16, the tube 236 is disintegrated and the pin 250 is sheared, causing the spear 244 to be driven downward and indent the inside surface of the sleeve 230. After the perforating job, the location of the indentation can be used to determine the actual orientation of the perforations.

Figure 49:
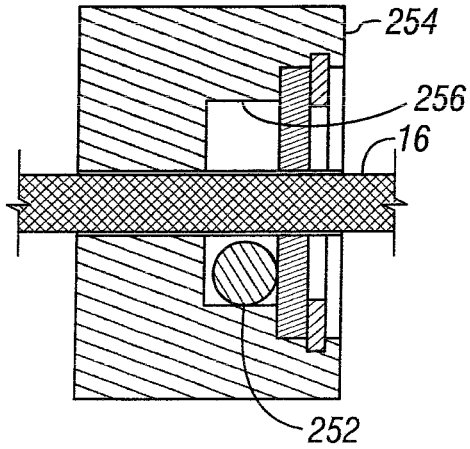
FIG. 49 illustrates another embodiment of the confirmation device of the present invention.

Still another embodiment of the confirmation device 200 is illustrated in FIG. 49. In this embodiment, a ball bearing (or counter weight) 252 is housed within a bearing housing 254 and allowed to rotate therein so that the ball bearing 252 remains on the low side of the bearing housing 254. The detonating cord 16 extends through the bearing housing 254 such that the ball bearing 252 is positioned between the detonating cord 16 and the inner wall 256 of the housing 254.

Upon detonation of the detonating cord 16, the pressure increase within the housing 254 causes the ball bearing 252 to create an indentation in the inner wall 256 of the housing 254. The bearing housing 254 is fixed in relation to the shaped charges such that the indentation is used to verify orientation of the perforations at the time of detonation.

In alternate embodiments, the housing 254 contains multiple ball bearings 252. Further, it should be noted that by using a housing 254 having a rounded shape in the axial direction, the orientation of the gun string may be determined in multiple axes. In other words, the ball(s) 252 rotate to the low side of the housing 254 enabling determination of the longitudinal angle of the guns as well as the rotational orientation.

Figure 50A:
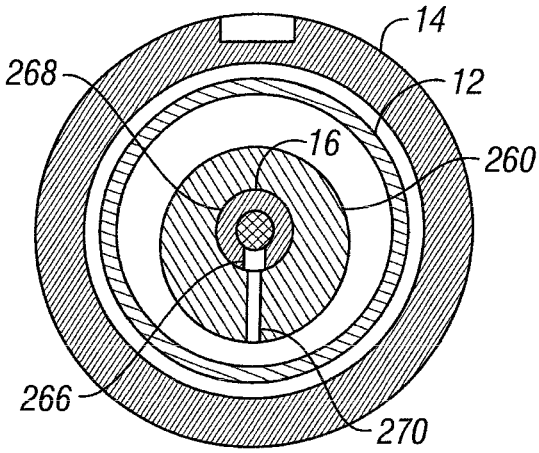
FIGS. 50A and 50B illustrate another embodiment of the confirmation device of the present invention.
Figure 50B:
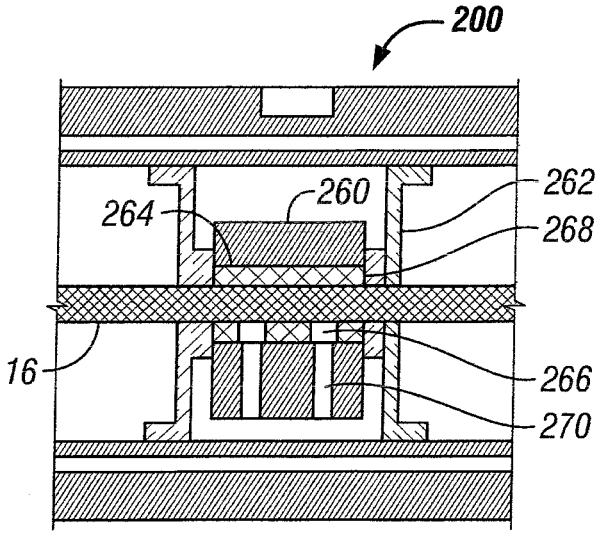

Yet another embodiment of the confirmation device 200 is illustrated in FIGS. 50A and 50B. In this embodiment, an eccentric weight 260 is mounted on a bearing support 262 having a bearing surface 264. The eccentric weight 260 rotates so that the weighted side remains in the lowermost position. The bearing support 262 has at least one radial passageway 266 extending therethrough. The detonating cord 16 extends through the central axis of the bearing support 262. An alignment tube 268 surrounds the detonating cord 16.

Upon detonation of the detonating cord 16, the alignment tube 268 creates shrapnel that passes through the one or more radial passageways 266 in the bearing support 262 and impinges the inner bearing surface of the eccentric weight 260. By knowing the orientation of the one or more radial passageways 266 with respect to the orientation of the shaped charges, the orientation of the perforations may be determined by inspection of the eccentric weight 260.

Figure 51A:
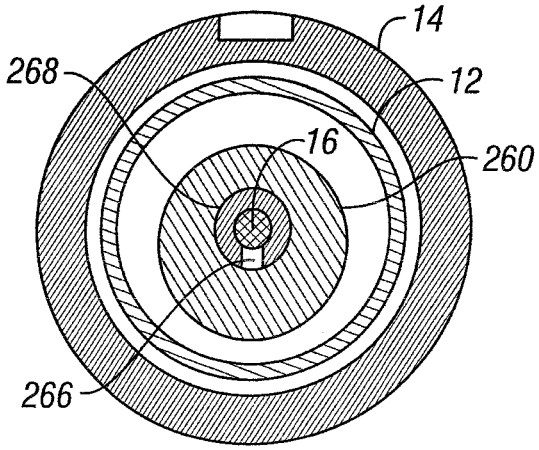
FIGS. 51A and 51B illustrate another embodiment of the confirmation device of the present invention.
Figure 51B:
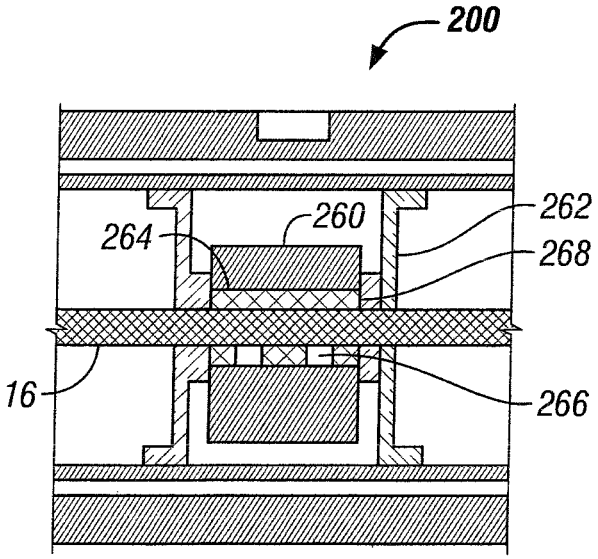

In an alternate embodiment of that illustrated in FIGS. 50A and 50B, the detonation cause the bearing support 262 to swell lock the relative position of the eccentric weight 260 and the bearing support 262. One example embodiment using the swell lock method is shown in FIGS. 51A and 51B. In this embodiment, the eccentric weight 260 has one or more radial passageways 270 that are aligned with the one or more radial passageways 266 of the bearing support 262. When the guns are fired in the correct orientation and the weight 260 is locked to the bearing support 262, the one or more radial passageways 266, 270 are aligned. The orientation may be verified by simply inserting a pin into the aligned passageways 266, 270 or by other inspection of the passageways 266, 270.

It should be noted that the confirmation devices 200 can be used at both ends of a fixed string of guns. In this manner, the orientation at both ends of the gun string can be confirmed. It should be further noted that the above embodiments of the confirming device 200 are illustrative and not intended to limit the scope of the present invention. The described features can be combined and modified and remain within the scope of the present invention. As one example, the hardened spear 221 of FIG. 47 can be used to pierce through a cylindrical sleeve thereby locking the sleeve to the external housing 216 and fixing their respective positions.

While the foregoing is directed to the preferred embodiment of the present invention, other and further embodiments of the invention may be devised without departing from the basic scope thereof, and the scope thereof is determined by the claims that follow. It is the express intention of the applicant not to invoke 35 U.S.C. §112, paragraph 6 for any limitations of any of the claims herein, except for those in which the claim expressly uses the word "means" together with an associated function.

We claim:

1. An oriented perforating gun affixed to a tool string, comprising:

one or more eccentrically weighted gun string components;

a swivel intermediate the one or more gun string components and the tool string, the swivel enabling the one or more gun string components to rotate independently from the tool string, the swivel comprising:

a thrust bearing;

a bearing floater adapted to cooperate in reducing the load applied to the thrust bearing upon application of a sufficient axial load to the swivel;

a shaft; and a collar, the bearing floater being positioned between the shaft and the collar such that an axial movement of the shaft relative to the collar under axial loading compresses the bearing floater, the bearing floater compressing until further axial movement of the shaft is prevented and any increased axial loading is transferred directly from the shaft to the collar without passing through the thrust bearing.

2. The oriented perforating gun of claim 1, wherein the bearing floater comprises a spring device.

3. The oriented perforating gun of claim 1, wherein the bearing floater comprises a slotted cylinder capable of deflection under a high load.

4. The oriented perforating gun of claim 1, wherein the thrust bearing is a roller bearing.

5. The oriented perforating gun of claim 1, wherein the swivel further comprises a split ring positioned to transfer axial loading directly from the shaft to the collar once the further axial movement of the shaft relative to the collar is prevented.

6. A system for use in a wellbore, comprising:

a tool string;

a perforating gun having at least one eccentrically weighted gun string component; and a swivel coupled between the perforating gun and the tool string, the swivel comprising a collar, a thrust bearing, and a bearing isolation device to limit the potential load acting on the thrust bearing, the bearing isolation device allowing tensile loading to pass through the thrust bearing until a threshold level, the bearing isolation device then directly transferring any further tensile loading directly to the collar instead of the thrust bearing.

7. The system as recited in claim 6, further comprising a roller adapter having a plurality of roller wheels to facilitate movement of the perforating gun and the tool string along the wellbore.

8. The system as recited in claim 7, wherein the plurality of roller wheels are housed within a roller cage.

9. The system as recited in claim 8, wherein the roller cage is mounted between the tool string and the perforating gun to rotate independently of the perforating gun and the tool string.

10. The system as recited in claim 7, wherein the plurality of roller wheels are aligned along a longitudinal axis of the roller adapter.

11. The system as recited in claim 6, wherein the bearing isolation device comprises a bearing floater adapted to reduce the load applied to the thrust bearing under high tensile loading.

12. The system as recited in claim 11, wherein the bearing isolation device comprises a shaft within the collar, the bearing floater being deployed between the shaft and the collar such that under sufficient tensile load, the bearing floater is compressed until any additional tensile loading is transferred from the shaft to the collar without passing through the thrust bearing.

* * * * *